US007871358B2

(12) United States Patent
Graham

(10) Patent No.: US 7,871,358 B2
(45) Date of Patent: Jan. 18, 2011

(54) HEIGHT ADJUSTABLE SHUTTLE TREATMENT TABLE/EXERCISE DEVICE METHOD AND APPARATUS

(76) Inventor: Gary Graham, P.O. Box 5085, Glacier, WA (US) 98244

( * ) Notice: Subject to any disclaimer, the term of this patent is extended or adjusted under 35 U.S.C. 154(b) by 0 days.

(21) Appl. No.: 12/704,272

(22) Filed: Feb. 11, 2010

(65) Prior Publication Data

US 2010/0144499 A1 Jun. 10, 2010

Related U.S. Application Data

(63) Continuation-in-part of application No. 11/549,902, filed on Oct. 16, 2006, now Pat. No. 7,682,297.

(60) Provisional application No. 60/726,782, filed on Oct. 14, 2005.

(51) Int. Cl.
*A63B 21/02* (2006.01)

(52) U.S. Cl. ..... 482/122; 482/142

(58) Field of Classification Search ..... 482/121–130, 482/140, 142, 148, 72, 139; 601/1, 5
See application file for complete search history.

(56) References Cited

U.S. PATENT DOCUMENTS

| | | | | |
|---|---|---|---|---|
| 2,340,666 | A | 2/1944 | Johanson | |
| 2,664,886 | A | 1/1954 | Coffman | |
| 3,620,530 | A | 11/1971 | Cosby | |
| 4,004,801 | A | 1/1977 | Campanaro et al. | |
| 4,561,649 | A | 12/1985 | Forsythe | |
| 4,706,953 | A * | 11/1987 | Graham | 482/96 |
| 4,869,499 | A | 9/1989 | Schiraldo | |
| 4,884,802 | A | 12/1989 | Graham | |
| 5,029,848 | A | 7/1991 | Sleamaker | |
| 5,039,093 | A | 8/1991 | Collier | |
| 5,042,797 | A | 8/1991 | Graham | |
| 5,066,005 | A | 11/1991 | Luecke | |
| 5,260,870 | A | 11/1993 | Tsuchiya et al. | |
| 5,263,913 | A | 11/1993 | Boren | |
| 5,279,530 | A | 1/1994 | Hess | |
| 5,312,315 | A | 5/1994 | Mortensen et al. | |
| 5,318,495 | A | 6/1994 | Malynowsky | |
| 5,364,327 | A | 11/1994 | Graham | |
| 5,499,958 | A | 3/1996 | Hess | |
| 5,599,260 | A | 2/1997 | Rovinsky et al. | |
| 5,645,516 | A | 7/1997 | Foster | |
| 5,653,667 | A | 8/1997 | Reyes | |
| 5,681,249 | A | 10/1997 | Endelman | |
| 6,042,523 | A | 3/2000 | Graham | |
| 6,244,992 | B1 | 6/2001 | James | |
| 7,288,053 | B2 * | 10/2007 | Endelman et al. | 482/142 |
| 2003/0119635 | A1 | 6/2003 | Arbuckle et al. | |
| 2005/0113227 | A1 | 5/2005 | Endelman et al. | |

* cited by examiner

*Primary Examiner*—Lori Baker
(74) *Attorney, Agent, or Firm*—Dwayne E. Rogge; Hughes Law Firm, PLLC

(57) ABSTRACT

The disclosure recites an apparatus having a kick plate that is adapted to be stored in an operable position where it is in a substantially vertically orientated manner where the kick plate is in a more vertically orientated or positioned orientation with respect to a frame and a carriage is movably attached in a substantially horizontal direction where a resistance system provides resistant movement of the carriage with respect to the frame. The kick plate is further adapted or operatively configured to be re-orientated in a stowed position where an upper surface of the kick plate operates in conjunction with an upper surface of the carriage to function as a table like support.

9 Claims, 25 Drawing Sheets

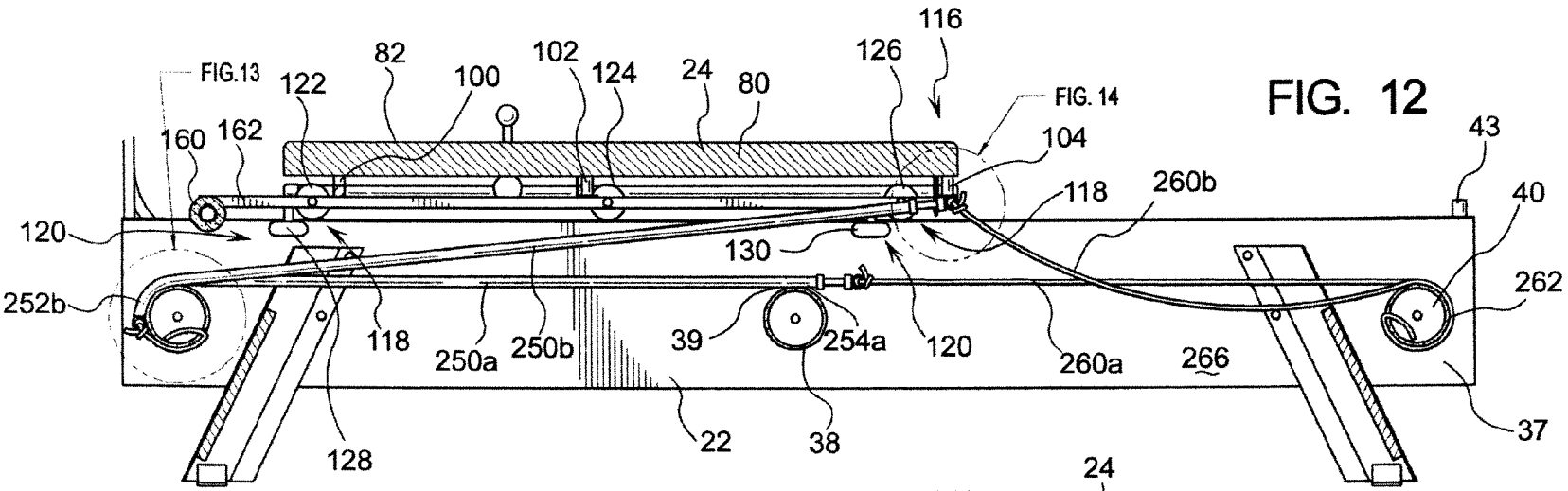
FIG. 12
43
40
262
37
266
260b
260a
118
104
FIG. 14
116
126
120
254a
38
130
39
80
24
22
124
102
250b
250a
100
82
118
128
122
FIG.13
162
160
120
252b
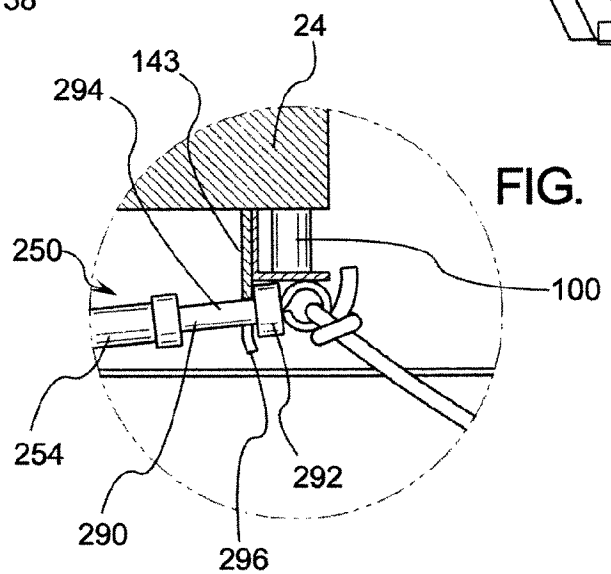
FIG. 14
100
24
292
296
143
294
290
250
254
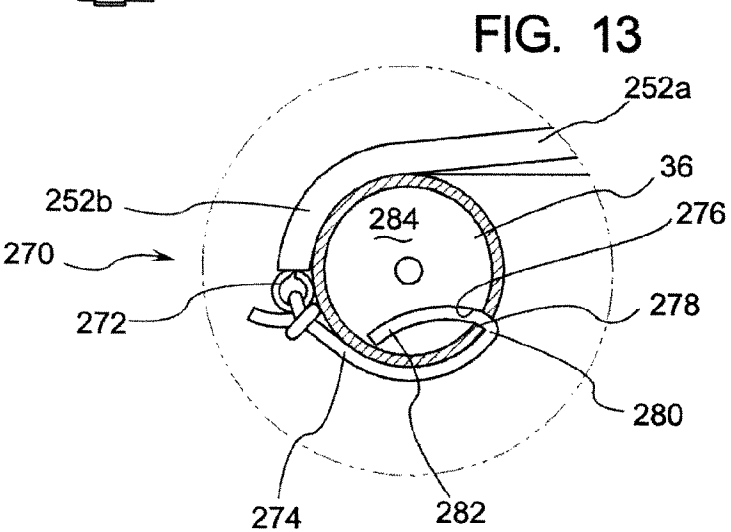
FIG. 13
252a
36
276
278
280
282
284
274
252b
272
270

HEIGHT ADJUSTABLE SHUTTLE TREATMENT TABLE/EXERCISE DEVICE METHOD AND APPARATUS

RELATED APPLICATIONS

This application is a Continuation in Part and claims priority benefit of U.S. patent application Ser. No. 11/549,902, filed Oct. 16, 2006, now U.S. Pat. No. 7,682,297 which in turn claims priority benefit of a U.S. Provisional Application Ser. No. 60/726,782, filed Oct. 14, 2005.

BACKGROUND OF THE DISCLOSURE

The invention relates to an exercise and therapeutic apparatus and more specifically the configuration of elements in addition to a wheel tracking system, load resistance configuration and combination treatment table.

The invention relates to the art of exercise apparatus that generally consists of a stationary frame, a horizontal moving carriage, a vertical kickplate, a resistance system, a rebound system and an adjustable range of motion system. The exercising participant is positioned supine on a reciprocating moveable carriage with one or both feet on a vertical kickplate. The participant self induces an oscillating or reciprocating motion in a longitudinal direction to the carriage against a variable resistance. The kickplate is normally attached to the foot end portion of the frame.

SUMMARY OF THE DISCLOSURE

Disclosed below is an exercise apparatus generally comprising a frame, a carriage, a kickplate, a plurality of adjustable legs and a resistance system. The support structure frame having a foot end, a head end, a leftward portion, and rightward portion. A carriage is provided having a footer portion, a header portion, a vertically upward surface, a vertically downward surface, a leftward lateral side and a rightward lateral side, the carriage being movably coupled to the support structure frame toward the head end of the frame to travel back and forth longitudinally along the frame. A plurality of elastic members coupled to the foot end of the frame on a first end and removably coupled to the carriage on a second end. A kick plate is provided and is movably coupled to the support structure frame toward the foot end of the frame such that it is rotationally positionable in a horizontal and a vertical position having a vertically upward surface and a vertically downward surface when in the horizontal position and the vertically upward surface of the kickboard when in the horizontal position is substantially continuous with the vertically upward surface of the carriage when the kickboard is in the stowed position.

The exercise apparatus can be arranged so the vertically upward surface of the carriage and the vertically upward surface of the kickboard when in the horizontal position are padded. The exercise apparatus as recited in claim 1 wherein the rebound system can be adjusted by way of a rope means and an adjustment means coupled to the frame of the exercise apparatus.

A plurality of lateral control wheels can be provided and coupled to the carriage configured so that the plane of rotation of the lateral control wheels is in a plane parallel with the longitudinal movement of the carriage along the frame and the lateral control wheels are in contact or intermittent contact with an L shaped bracket coupled to the frame wherein the L shaped bracket prevents the carriage from becoming detached from the frame and reduces friction between the carriage and the support structure frame.

The exercise apparatus further including a headrest positionably coupled to the vertically upward surface of the carriage.

A locking mechanism can be employed to orientate the kickboard in an operable orientation. The locking mechanism comprises a loop leverage fastener where the kickboard further comprises downward extending members, each having a receiving portion where a loop member is pivotally attached to the base frame and adapted to replace a downward force upon the downward extending members of the kick plate.

The rebound system can be comprised of a first and second cord section, where the first ends of the cord sections are attached to the carriage and second ends are operatively attached to the frame. The first and second cord sections are further attached to first and second cord extension portions where the length of the first and second cord sections can be adjusted by adjusting the length of the first and second cord extension portions.

The first and second cord sections in one form have an elastic member attached thereto to resist lateral displacement of the first and second cord sections. The first and second cord portions are attached to one another in a central location and a fastener is attached thereto which is fixedly and removably displaced in a longitudinal direction to adjust the lengths of the first and second cord sections.

As described in detail herein the carriage is provided with an adjustable headrest positioning system where a headrest comprising a headrest member that is fixedly and repositionally positioned upon the carriage.

Referring still to the carriage, a vertically extending member of the carriage comprises an attachment system where surfaces define a plurality of slots of attachment regions positioned vertically to proximately correlate to the lateral position of elastic members of the resistant system. The carriage can further have a foot rest member is provided and positioned sufficiently below an upper surface of the carriage member so the kick plate stores is positioned there above the foot rest member when in a stored orientation.

The resistant system of the exercise apparatus comprises a plurality of elastic members where at least a portion of the elastic members are attached to a portion of the frame where a fixing cord located at a first region of an elastic member at least one of the elastic members extends through an opening at a substantially right angle to the portion of the fixing cord adjacent to the first end of the elastic member to secure the elastic member to the frame where a spreader bar is provided to separate first and second frame members longitudinally extending frame members of the frame where the spreader bar is positioned at a foot region of the frame and includes a surface defining an opening adapted.

The frame can have a spreader bar positioned at a foot region of the frame where the spreader bar provides the opening for the fixing cord of an elastic member and the spreader bar defines an interior chamber region where an internal end of the fixing cord extends therein. The tension of the elastic member is adapted to be changed by way of first relaxing the tension in the elastic member and adjusting the length of the fixing cord within the opening.

The resistant system comprises at least one elastic member where the elastic member has first and second ends where attached at the first end is a fixing cord that is operatively configured to extend through the opening of the spreader bar to fix the first end of the elastic cord to the frame. The elastic cord further comprises an attachment cord portion that is connected to the second end of the elastic member and further connected to a second spreader bar positioned at the head region of the frame.

A motion control system is provided and comprises an operating region having first and second cord sections, each having a portion being attached to the frame and an opposing portion attached to the carriage and an elastic member attached to the first and second cord sections resisting separation in a lateral direction of the first and second cord sections.

The first and second members extend though contact points of the frame and extend in a longitudinal headward direction where the first and second members are adjusted in length by fixedly attaching the first and second members to the frame.

The first and second cord sections are attached to one another at the headward region of the frame and an adjustment mechanism is provided where an attachment member is configured to be fastened to a spreader bar positioned in the head-region of the frame.

BRIEF DESCRIPTION OF THE DRAWINGS

FIG. 12 shows a sectional view in the lateral direction where one elastic member is engaged with the carriage and a second elastic member is shown in a disengaged orientation;

FIG. 13 is a close up view of the attachment of a method of attaching the elastic members to the frame;

FIG. 14 shows a method of attaching the elastic members to the carriage;

DESCRIPTION OF THE PREFERRED EMBODIMENTS

Figure 1:
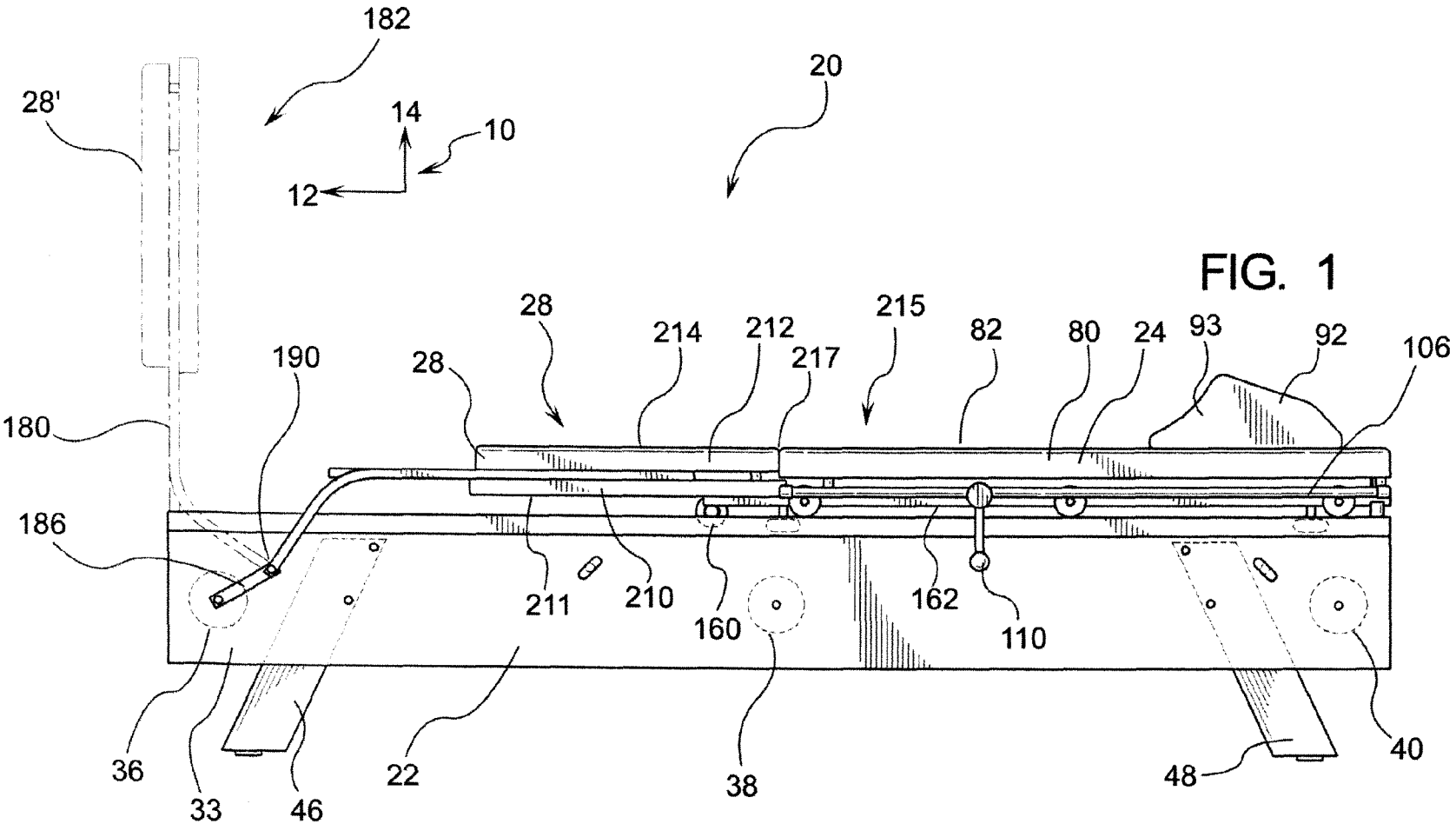
FIG. 1 shows a side view of the apparatus.
Figure 2:
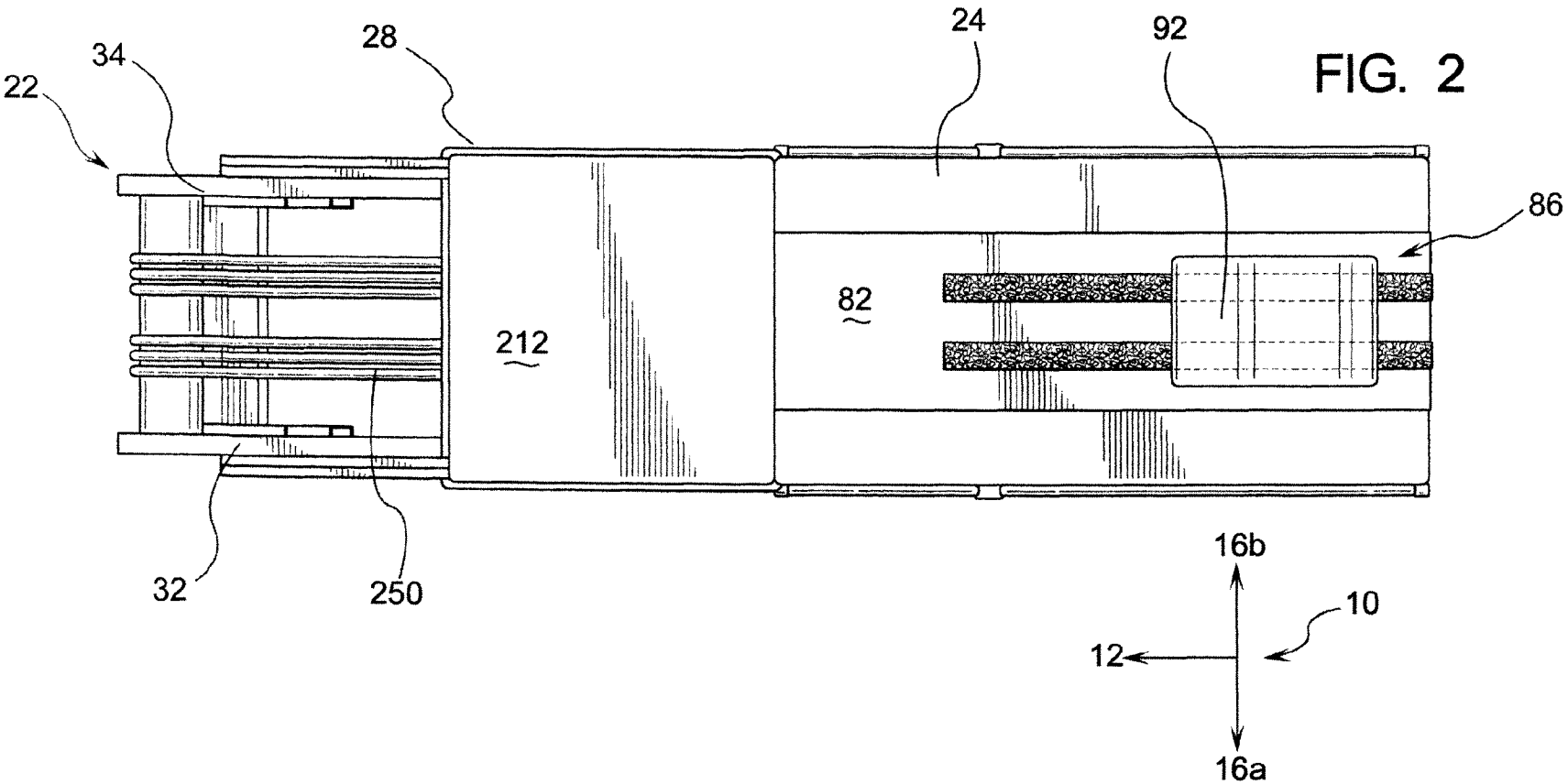
FIG. 2 shows a top view of the apparatus with the kick plate in a stowed or horizontal orientation.
Figure 6:
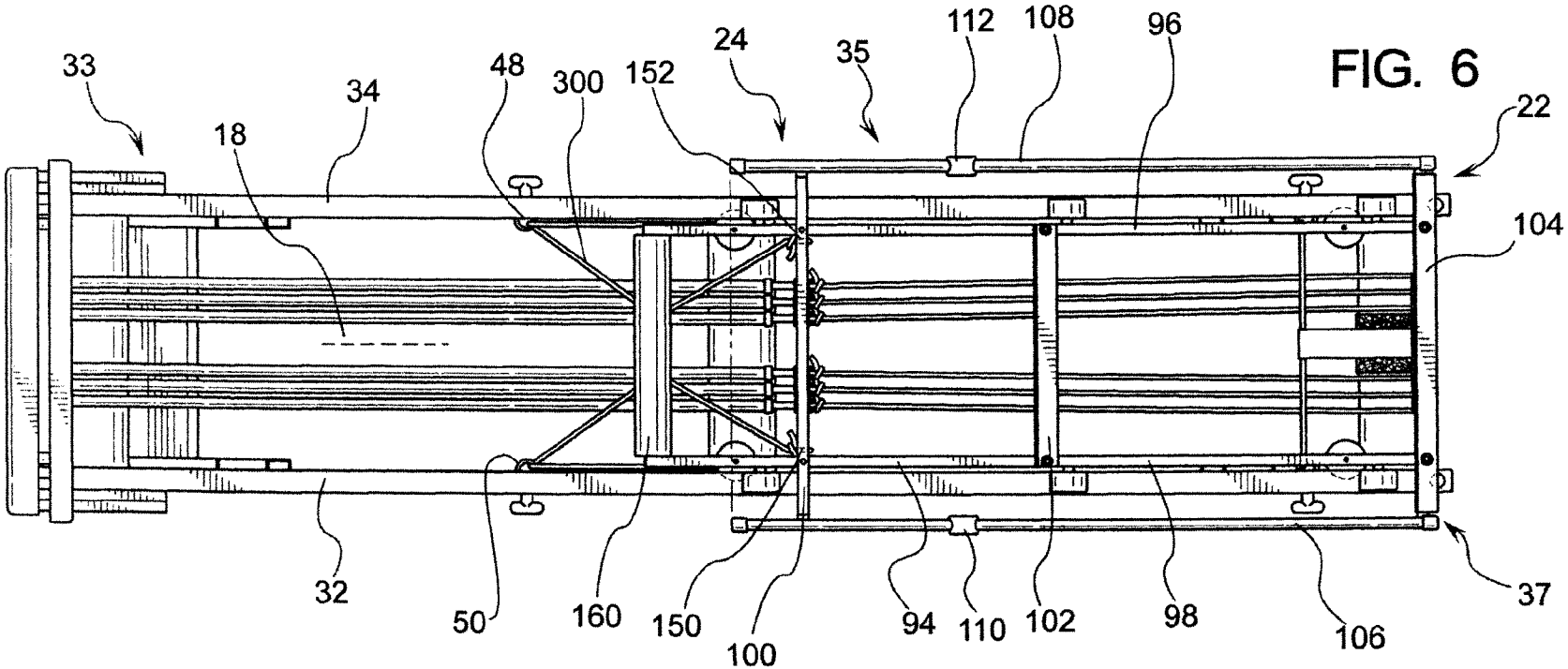
FIG. 6 is taken along line 6-6 of FIG. 3 showing the rebound system and the resistance system.

Referring to FIG. 1, there is the apparatus 20 which is shown in a stowed orientation wherein the left-hand portion kick plate 28 as shown in an inoperative orientation. Before going into a more detailed discussion, an axis system 10 is utilized to help describe the drawings herein. In general, the axis indicated at 12 indicates a longitudinal direction and the arrow points in a foot ward direction. The axis indicated at 14 is a vertical axis and indicates a vertical direction. An axis system 10 as shown in FIG. 2 at 16A and 16B indicates a lateral direction where 16A is directed to a direction herein referred to as the left direction and 16B indicates a rightward direction. As shown in FIG. 6, a center longitudinal reference axis 18 is shown that is positioned substantially at the lateral symmetrical center of the unit 20. Of course, the axis described hereunder are for general reference purposes and are not necessarily orthogonal but generally indicate directions for ease of description and general orientation of components described herein.

In general, the apparatus 20 is comprised of a support structure frame 22, a carriage 24, a resistance system 26, a kick plate 28 and further in one form, a rebound system 30 or otherwise referred to herein as a range of motion control system.

Figure 3:
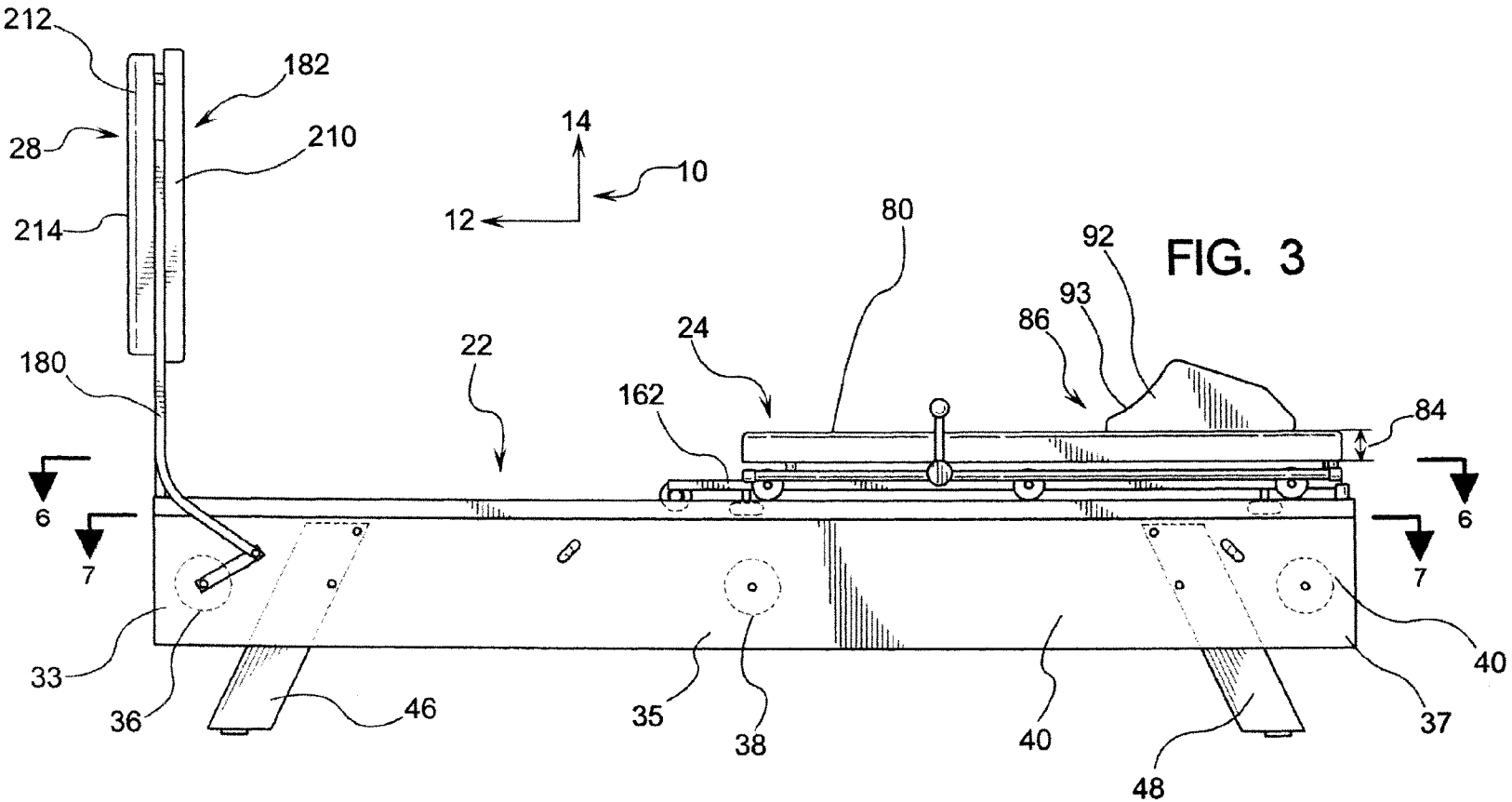
FIG. 3 shows the apparatus in a side view with the kick plate in an operable orientation and the carriage positioned in a longitudinally head ward orientation.

As shown in FIG. 2, the frame 22 comprises in one form two longitudinally extending frame members 32 and 34 in one form. The longitudinally extending frame members 32 and 34 are connected by way of a plurality of spreader bars which are best shown in FIG. 3 in a hatched line at 36, 38, and 40. In one form, there are three spreader bars employed where the spreader bar at 36 is positioned at the foot end region 33 of the frame 22 and the spreader bar 40 is positioned at the head portion 37. In general, the frame member 22 as shown in FIG. 6 generally comprises a foot region 33, the central region 35 and a head region 37. In one form, a plurality of legs generally indicated at 46 and 48 are utilized to hold the members 32 and 34 upwardly. Another embodiment, shown in FIGS. 28-30 employs height adjustable legs. As shown in FIG. 6, the frame member 22 has mounting points 48 and 50 positioned at adjacent sides of the frame member that operate in conjunction with the rebound system 30 as further described herein with reference to FIG. 7. Further, as shown in for example FIG. 7, the second set of mounting points indicated at 52 and 54 are further provided which further operate in coordination with the rebound system 30. As shown in FIG. 8, the legs 48 comprise the foot engagement portion 60 at a laterally extending plate 62 which is connected to two laterally adjacent legs 48 for rigidity and support. In some forms, the legs 48 can fold for a shipping or storage type orientation. Otherwise, the legs can be rigidly attached to each of the lateral frame members 32 and 34 at the attachment points generally indicated at 64 as shown in FIG. 8.

Figure 5:
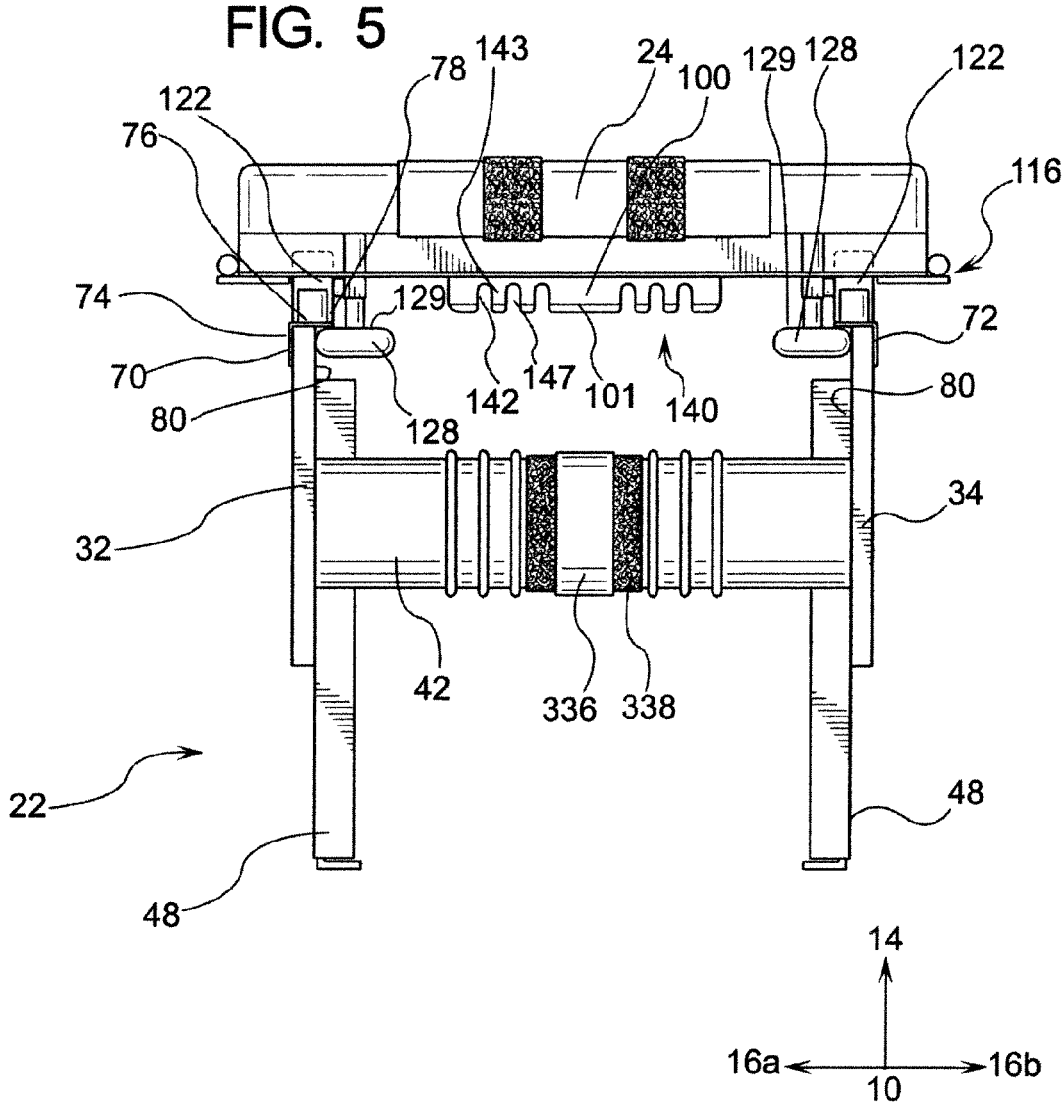
FIG. 5 is a view taken in a longitudinal direction at the head ward region of the apparatus.

Now referring to FIG. 5, it can be seen along the longitudinal axis how the frame members 32 and 34 are positioned in a substantially vertical orientation. In the upper portion of each of these frame members are wheel engaging members 70 and on the opposing side a similar type member 72. In general, the members 70 and 72 are fixedly attached to the longitudinal members 32 and 34. As further shown in FIG. 5, in one form the wheel engagement members 70 and 72 have a vertically orientated portion 74 and a horizontally extending region 76. In one form, the horizontal extending region 76 has an extension 78 which extends beyond the surface defined by the plane which in turn is defined by the upper surface 80 of say for example the longitudinally extending members 34. Of course, this discussion is relevant and for the opposing frame member 32. As described further herein, this arrangement is effective because the weight support wheels 122 and the lateral controlling wheels 125 operate with the extension 78 and the upper surface of the horizontal member 76 to keep the carriage 24 movably positioned upon the frame 22. As shown in FIG. 12, a stopper member 43 is provided at the longitudinal head portion 37 of the frame. This allows for maintaining the carriage 24 upon the frame member 22.

Referring to FIG. 5, there will now be a discussion of the spreader bars with in particular reference to the spreader bar 40. It should be noted that not only are the spreader bars 36, 38 and 40 are provided for structural integrity for the frame member 22. But further, can serve utility such as providing a location for a fixedly and removably positioning certain members of the rebound system 30 for adjustment thereof. This will be described further herein in detail below.

Figure 4:
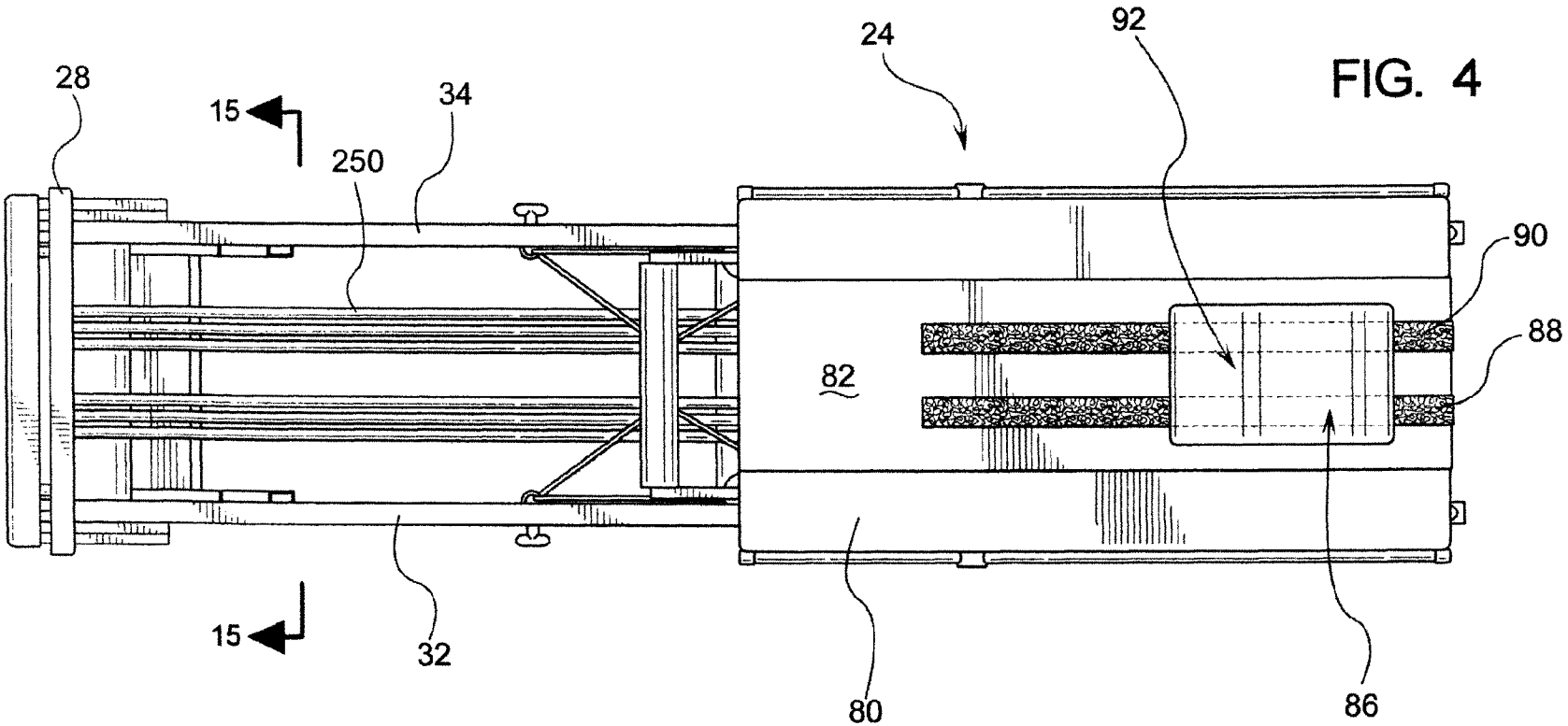
FIG. 4 shows a top view of the apparatus with the kick plate in an operational orientation.
Figure 23:
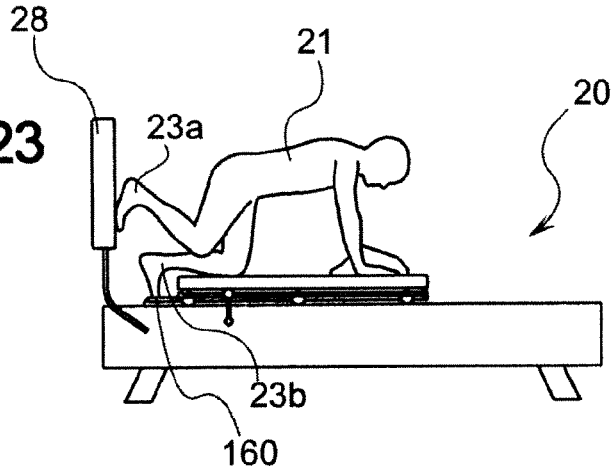
Figure 24:
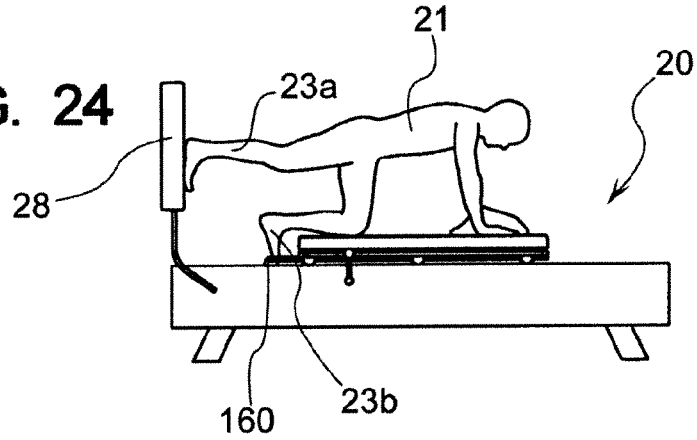

With the foregoing description of the frame member 22 in mind, now referring to FIG. 3 there will be a more detailed discussion of the carriage member 24. In general, the carriage operates to be movably positioned in a longitudinal direction with the frame member. Referring to FIG. 4, where there is a top view of the carriage 24 where it can be seen how the carriage is provided with a base member 80 which has an upper surface 82 that is adapted to support a patient thereon. In general, as shown in FIG. 3, the base member 80 has a thickness indicated 84 which is generally provided to provide a certain amount of padding to conform to the contour of an exercising participant laying thereon. As described further herein with reference to FIGS. 16-28, there are numerous orientations an individual can be positioned upon this base member some of which are in a sideways orientation as in FIGS. 19-22 where their hips would engage the padding or a downward facing kneeling like stance as shown in FIGS. 23-24 where their knees would need to engage the padding for comfort and proper support. As further shown in FIG. 4, the upper surface 82 can be provided with an adjustable headrest positioning system 86 which in one form comprises a hook and loop like fastening system where hook and loop fasteners 88 and 90 are attached to the upper surface or a part of the upper surface 82. In one form two longitudinal extending strips of hook and loop type fasteners can be utilized but of course a plurality of modifications in orientations can be employed. As shown in FIG. 3, the headrests member 92 is optionally employed and is fixedly and repositionally attached to the upper surface 82 by way of having a corresponding hook and loop fastener system to cooperate with the strips 88 and 90. Now referring to FIG. 3, the headrest 92 has a forward surface 93 adapter to receive force from the exercise participant. Of course in one preferred form, the softer less rigid strouds section of the portion of the hook and loop fastening system can be positioned on the upper surface 82 for comfort of the user.

Now referring to FIG. 6, this Fig. essentially shows the frame member 94 of the carriage system. FIG. 6 is taken at line 6-6 of FIG. 3 and basically shows the lower portion of the carriage system 22 with removal of the base member 80. In one form, the base member 80 is removable for maintenance and for example cleaning of the unit. As shown in FIG. 6, the frame member 94 comprises first and second longitudinal frame members 96 and 98. In one form, the longitudinal carriage frame members are positioned inwardly from the frame members 32 and 34. The frame members are in general positioned laterally outward from the center axis 18 of the machine and are connected by one or more laterally extending members. In one form, the frame member 94 of the carriage 24 is comprised of three laterally extending members which are indicated at 100, 102 and 104. As described further herein, the laterally extending members such as that is shown such as the member 100 can be further utilized to engage the resistance system 26 for application of elastic members attached thereto. In one form, positioned laterally outwardly from the unit are first and second guide bars 106 and 108 The handle members 110 and 112 are optionally attached thereto and as shown for example of FIG. 1 can be positioned in a downward orientation or in an outward orientation for grasping by the exercising participant of the device 20.

Referring now to FIG. 12, there will now be a discussion of the mobility system 116 of the carriage 24. In one form, the mobility system is comprised by a plurality of wheels or bearing like members. In general, in one form the wheels can be separated into the weight bearing wheels generally indicated at 118 and the lateral wheel bearing system 120. As shown in FIG. 12, the weight bearing wheel system 118 is comprised of three sets of wheels (in one form) generally indicated as 122, 124 and 126. Further, the lateral bearing system 120 in one form is comprised of two pairs of the wheel members indicated at 128 and 130 which are orientated substantially about a vertical axis. As introduced above, with reference to FIG. 5, the mobility system 116 cooperates with the frame member where for example the wheel members 128 are adapted to engage the inner surface 80 of the longitudinal the extending members 32 and 34. The upper surface 129 of the laterally extending wheels 128 can be utilized to engage the extension 78 in dynamic situations described below. Of course, other materials can interpose there between but the base structural member in this property of the members 32 and 34 provide a rigid platform for the lateral bearing member system 120 to prevent an excessive amount of rotation of the carriage about a vertically orientated axis. Oftentimes it is desirable by the exercising participant to have more of a linear, longitudinal motion with a minimal amount of "rattling" or undesirable friction or lateral movement of any form. Of course, these members can be orientated with a slight interference fit to put a slight outward pressure between the wheel members 128 and the frame members 32 and 34.

Still referring to FIG. 5, it can be seen how the weight bearing rearward orientated bearings or wheels 122 are shown resting upon the upper portion of the frame members 32 and 34. As described above, in one form the L-shaped members 70 and 72 are utilized to provide a surface for these wheels and the upper surface 129. The upper surface 129 of the wheels 128 can engage the lower surface of the extension 78 as shown FIG. 5 in the event that there is a vertical force upon the carriage member 22. Although this would happen infrequently, these extensions would prevent the carriage member from falling or being separated from the frame member 24 above.

Still referring to FIG. 5, there is shown an attachment system 140 where in one form the laterally extending member 100 is comprised of surfaces 142 defining the plurality of slots 142 defining an attachment region. In general, the lateral positioning of the slots at least partially correlates with the orientation of the elastic members 250 such that as is shown in FIG. 6. Between the slot regions 142 are extension members 143 where as shown in FIG. 14, have a slight longitudinal head ward extension 296 to more properly engage the head portion 292 of the attachment portion 290 of the elastic members 250. As described further herein with reference to the resistance system 26, this attachment system 140 as shown in FIG. 5 provides a convenient attachment location for one or more elastic members 250 of the resistance system 26 for providing selective resistance of the carriage in a longitudinal direction with respect to the frame 22. Therefore, in one form, the attachment system 140 can function as the elastic member attachment portion 101 of the resistance system 26 described herein.

Figure 7:
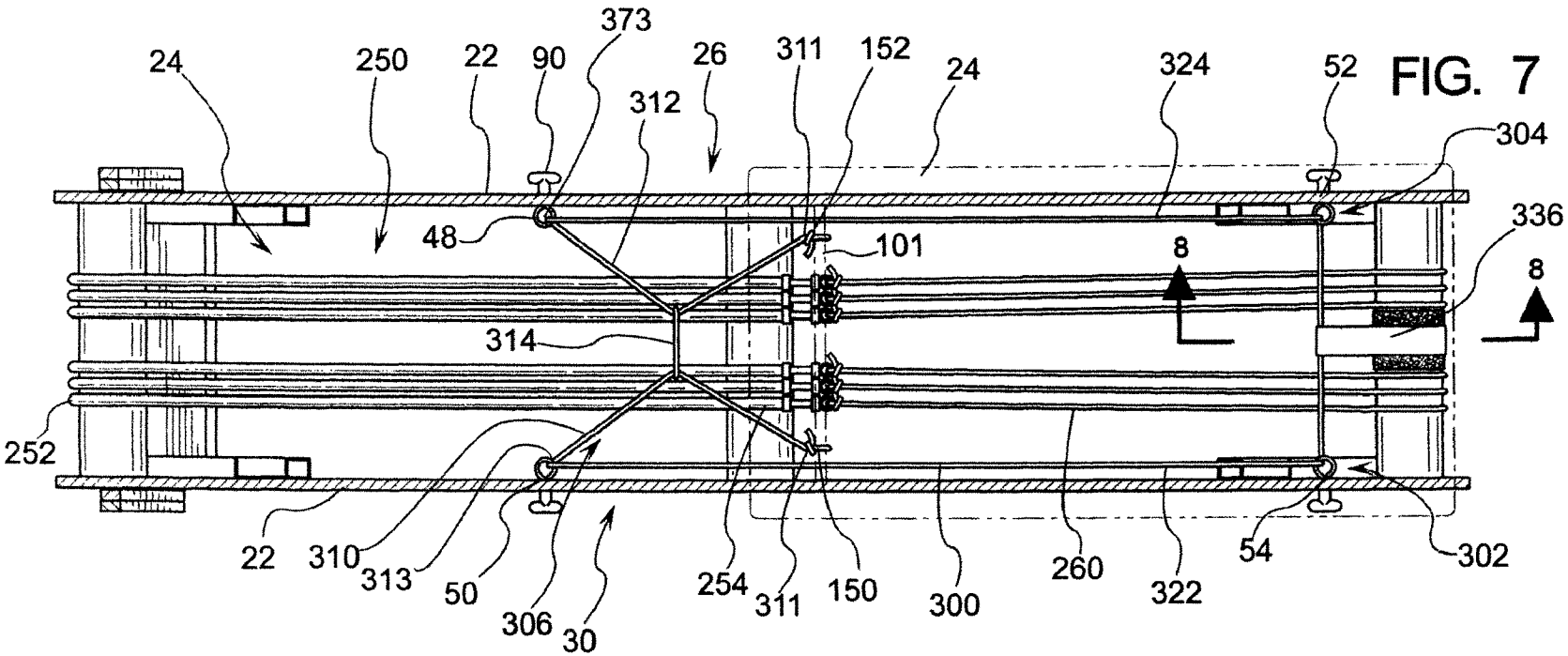
FIG. 7 is taken along lines 7-7 of FIG. 3 showing in greater detail the motion control/rebound system and the resistance system.
Figure 8:
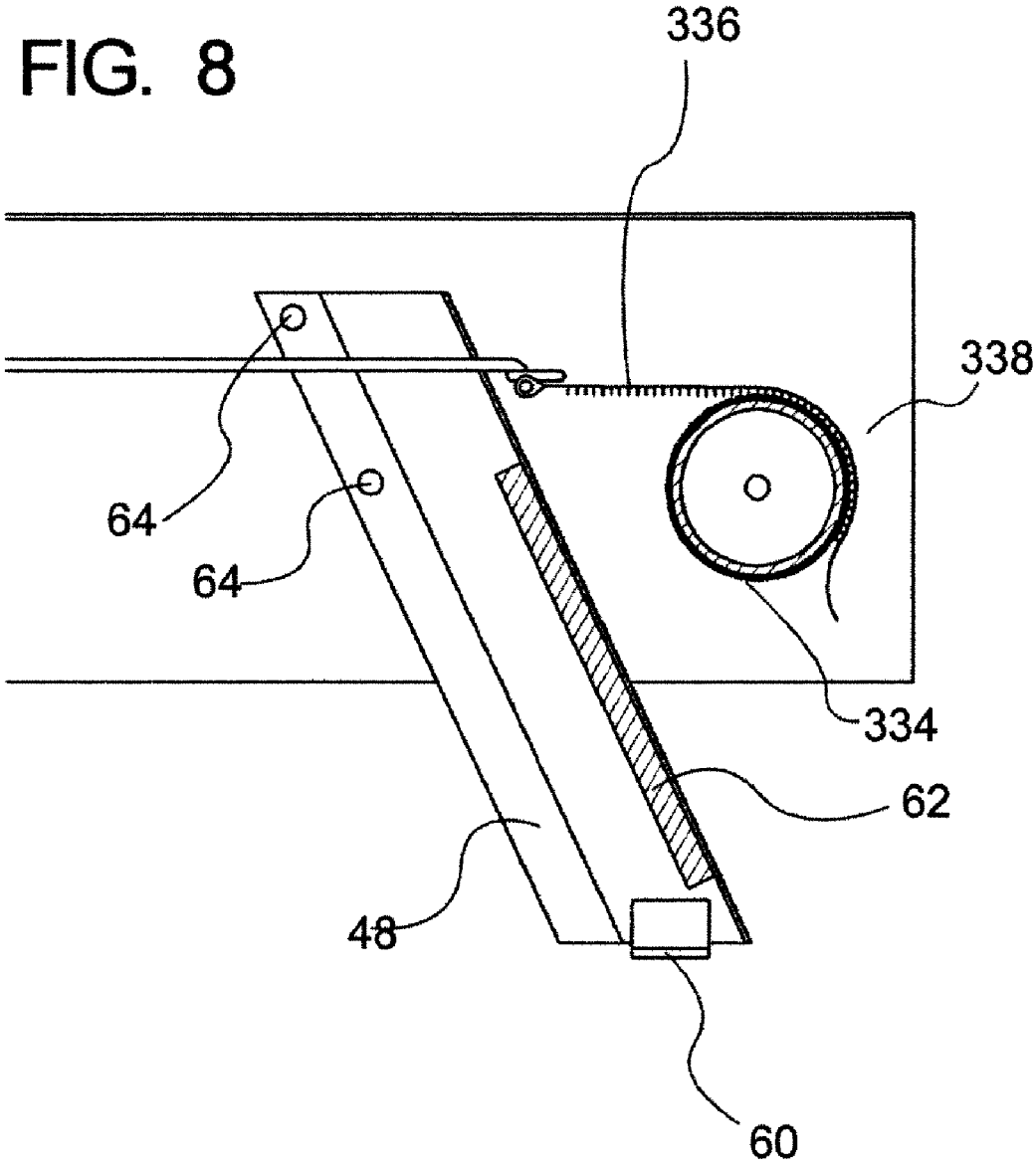
FIG. 8 is a sectional view showing an adjustment feature of the motion control system.

Now referring to FIG. 6, it can be seen how the laterally extending bar 100 in one form provides anchor points 150 and 152 for attachment of the control cord 300 which is described further herein with a detailed discussion of the rebound system 30, with reference to FIG. 7. It should be noted of course that the carriage 24 can be oriented in a plurality of manners where for example the anchor points 150 and 152 could be configured for example it could be configured on the members 96 and 98. Now referring to FIG. 12 and describing the carriage 24, it can be seen how the longitudinally extending frame members terminate near a footrest member 160. The footrest member in one form extends below the upper surface 82 of the base member 80 for more of a desirable ergonomic orientation for the exercise participant. Further, the foot member 160 having the base portion 162 can extend underneath the kick plate when in a stowed orientation such as that as shown in FIG. 1. In one form the footrest member 160 is padded for the comfort and safely of the exercising participant.

Referring now back to FIG. 1, there is shown a side profile view of the apparatus 20 where the foregoing description as discussed the frame member 22 in detail. Positioned at the foot region 33 of the frame member is the kick plate 28. As shown in FIG. 1, the kick plate is in the stowed orientation and in the left-hand portion of FIG. 1 the kick plate 28' is in the operable orientation. Of course it should be noted that in the stowed orientation the unit 20 is still of course operable but can operate in a different fashion such as a treatment table, traction table, or the like.

In general, the kick plate 28 comprises a base frame 180 and a participant engagement region 182. Base frame 180 is pivotally attached at the foot region 33 of the frame 22. In one form, the base frame 180 is pivotally attached near or at the spreader bar 36 where a linkage like member 186 is fixedly attached to the frame 22 as shown if FIG. 1. Of course, the base frame 180 can be pivotally attached to the main structural frame 22 in a variety of manners. As shown in FIG. 3, the kick plate 28 is in the operable position and referring to FIG. 15, it can be appreciated the linkage member 186 can provide structural support and further orientate the pivot point indicated at 190 to a more central longitudinal location of the unit 20. In one form the kick plate 28 can extend footwardly beyond the frame.

Figure 15:
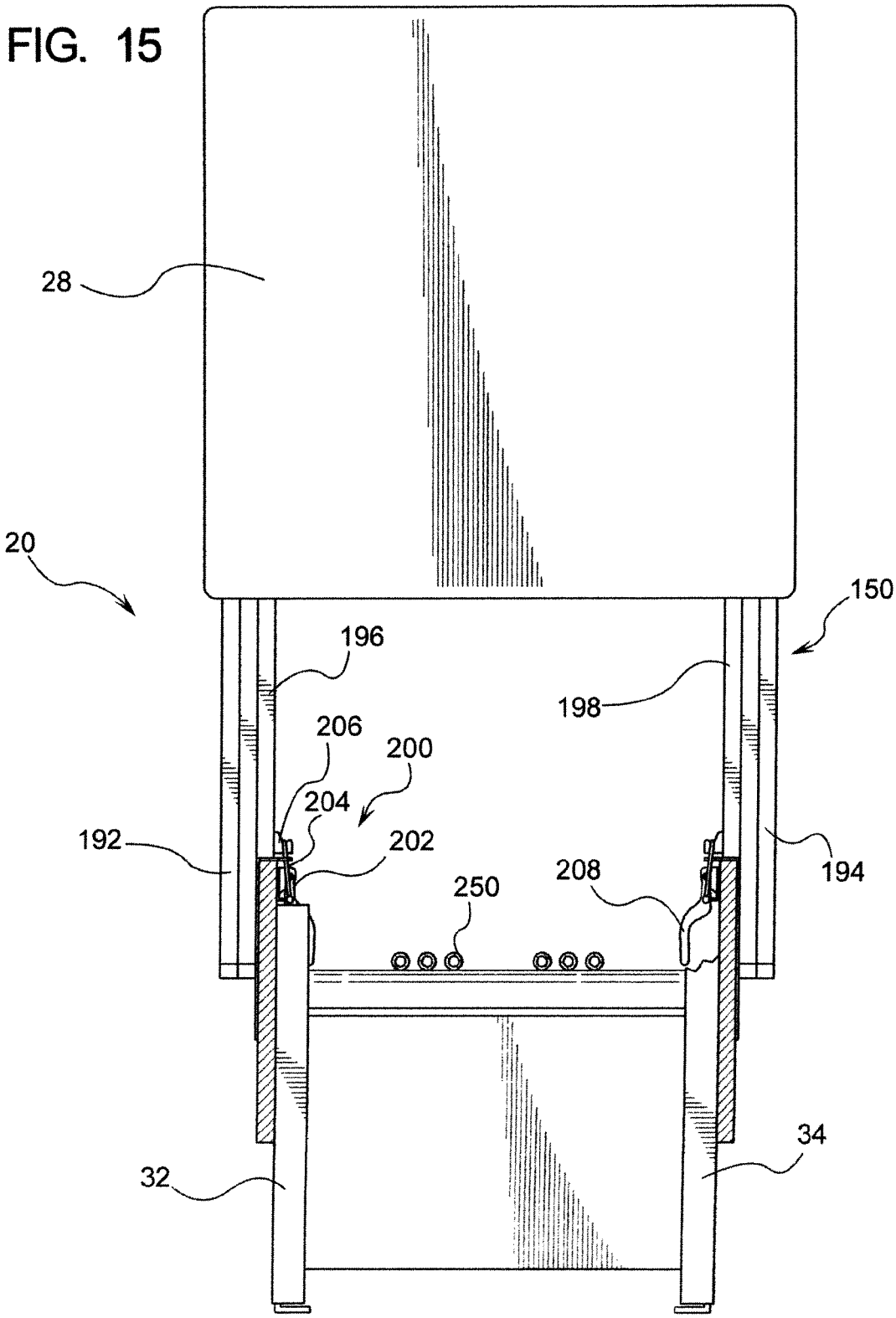
FIG. 15 is a sectional view taken along lines 15-15 of FIG. 4.

Still referring to FIG. 15, there is a view taken along line 15-15 of FIG. 4 where it can be seen that the base frame 180 is comprised of the support frame members 192 and 194. In one form, positioned laterally inwardly are the members 196 and 198. The kick plate locking mechanism 200 in one form is a latch like system terminated where locking mechanisms are positioned at the inward portions of the members 196 and 198 and a conventional loop like lock member 202 has a pivotally attached rigid loop member 204 as positioned around the receiving portion 206 and a handle like mechanism 208 provides leverage to lock the kick plate 28 in a vertical orientation. Of course, any number of types of locking mechanisms can be employed.

Referring now to FIG. 3, the participant engagement region 182 of the kick plate comprises first and second portions of 210 and 212. The first portion 210 is primarily engaged in the operable configuration such as that as shown in FIG. 3. In general, this material is substantially sufficiently robust to handle impacts placed thereon and having for example shoes or bare feet of an exercising participant engage as described further herein in particular with reference to FIGS. 16-28 as described herein below. As shown in FIG. 1, the first portion 210 is in a stowed orientation where there is sufficient clearance between the kick plate 28 and the surface 211 where the outer surface 214 is in substantially a planar relationship with the surface 82 as described immediately below.

Still referring to FIG. 1, the second section 212 is in general in one form a similar material as the base portion 80 where this for example would be more softer foam type material that has a similar feel and compression rate as the material 80. The second section 212 has an outer surface 214 where as shown in FIG. 1 the kick plate 28 is orientated in a manner where in the stowed position the surfaces 214 and 82 are substantially in a planar relationship. As further described herein, the surfaces 214 and 82 are also somewhat contiguous in nature however, after a thorough discussion of the range of motion control system 30 the net length of the support surface can be altered. Of course by having the surfaces 80 and 212 substantially in-plane, there of course can be deviations but this is broadly defined so the two surfaces can operate as a proper horizontal surface for use of say for example a therapeutic type table. Of course, the surfaces may not be perfectly in the same plane and say for example one of the padding is a little bit thicker for specific therapeutic reasons, but to be substantially in plane, the surfaces are reasonably contiguous to operate as a for example treatment table.

The surfaces 214 and 82 are generally referred to as a table surface generally indicated at 215 in FIG. 1. When the unit 20 is functioning as a table surface 215, the combined surfaces 214 and 82 provide sufficient surface area for a plurality of therapeutic treatments or simply a general surface which is utilized in treatment centers, athletic facilities, home use or elsewhere where the device 20 is implemented. It should be noted that the support surface 215 need not be absolutely contiguous where the interface region 217 can be slightly separated to lengthen the overall longitudinal length of the support surface 215. In one form, as described below, the rebound control system can be utilized to allow this separation between the foot plate 28 and the carriage 24 to lengthen the support surface 215.

Figure 10:
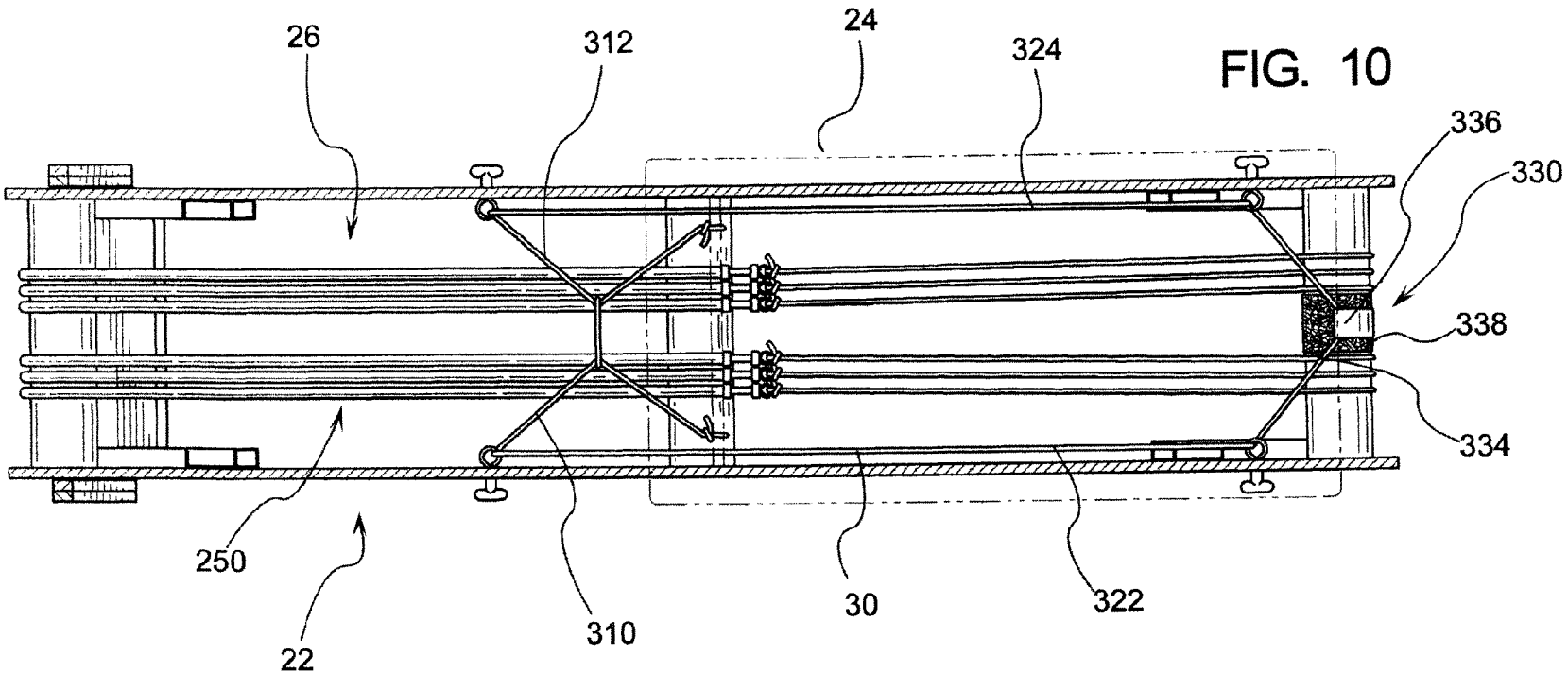
FIG. 10 shows how the adjustment system of the motion control system is utilized to shorten the length of cords that are in engagement with the carriage.

With a thorough discussion of the frame member 22, the carriage 24 as well as the kick plate 28 in place, there will now be more detailed discussion of the resistance system 26 with initial reference to FIG. 10. In general, the resistance system 26 operates to provide an adjustable amount of resistance between the carriage 24 and the frame 22 in a longitudinal direction. It is desirable to have a user-friendly, accessible resistance system 26 for adjusting the amount of resistance applied to the carriage 24.

In general, the resistance system 26 is comprised of a plurality of elastic members 250. For convenience purposes each of the members as described herein will be described with the numeral 250 with the alpha character "a", "b", etc. positioned adjacent thereafter. As shown in FIG. 7, all of the elastic members 250 are in an engaged orientation where they are fixedly removably attached to the carriage 24 at the elastic member attachment portion 101 such as that as shown in FIG. 5. As described above, the surfaces 142 defining the vertically aligned slots 147 as shown in FIG. 5 are adapted to engage the terminal portions of the elastic members 250. Of course, there are a plurality of methods of attaching the elastic members 250 to the carriage but this is one chosen form. It should be noted that the term elastic member is defined broadly for any type of member that resists expansion from a one length to another. In one form, the elastic members are comprised of a conventional bungee cord type material. Of course, in other forms various forms of helical springs or the like can be utilized. Further, if the elastic members 250 are for example loops of some sort, the loop portion could engage for example vertically downward extending portion between two adjacent slots 147 in FIG. 5. Or additionally, if a loop is simply positioned in the end portion of the elastic of the elastic member 250, this loop portion can engage a vertically oriented pin on the carriage.

Referring to FIG. 7, in general the elastic members 250 comprise a first end 252 and a second end 254. Now referring to FIG. 12, there is shown a side cross sectional view of the unit taken at line 12-12 of FIG. 11. As shown in this figure, there is shown one elastic member 250*a* in a disengaged position and one elastic member 250*b* in an engaged position.

Referring back to the discussion of the spreader bar 38, it is desirable to have the elastic member 250*a* and more particularly the attachment cord 260*a* in a more vertically upright orientated position when in the not engaged position so the therapist or otherwise the individual adjusting the tension can more readily grab the central portion of the attachment cord 260*a* and reposition the elastic member 250*a* and to an engaged orientation such as that as shown as the elastic member 250*b*. It should be noted that when in an engaged orientation, the attachment cord such as that as shown 260*b* is allowed to drop in the general region indicated at 266 as the carriage 24 repositions in a longitudinally head ward direction. Of course this type of attachment system is similar to that as shown in U.S. Pat. No. 6,831,122 which in its entirety is incorporated by reference.

Now referring to FIG. 13, there is shown one form of an attachment system indicated at 270 for the elastic members 250. As shown in FIG. 13, the first end 252*b* of the particular cord 252*a* is attached by way of having a cord insert 272 which one form can be in eyebolt or the like. A fixing cord 274 is provided where a surface 276 of the spreader bar 36 provides an opening 278 which is of sufficient diameter to allow the fixing cord 274 pass there through. Therefore, when the cord 252*a* is under tension, giving the sharp angle generally indicated at 280 of the cord, there is enough frictional resistance where the elastic member 252*a* will remain in place even when under a high tension. It should be further noted that as the dynamics of the properties of the elastic member for example 250*a* changes, certain members may have a different spring coefficient and other adjacent members. Or further, a certain amount of pretension may be more desired. Therefore, a simple adjustment system is to reduce the slack within the elastic member 250*a* and reposition the fixing cord 274 having the internal end 282 be further extended therein the central chamber region 284 of the spreader bar 36. Of course, the total length of the elastic member can be lengthened in a similar matter by withdrawing the fixing cord 274 therefrom the chamber region 284.

Referring back to FIG. 12, it should be noted that the portion 250 and 260. is commonly referred to as a resistance member. It should be noted that on the opposing portion of the elastic member 250, there is shown a similar type of attachment system for the attachment cord portion 260. Where the discussion and above with reference to FIG. 13 is at least in part relevant to the same underlying principles of the attachment portion of the head region of the attachment cord 260*a*.

Now referring to FIG. 14, it can be seen how the chosen attachment mechanism where the second end of mechanism 254 has an attachment portion 290 which in general has a head portion 292 that is of a greater diameter than the neck region 294. Therefore, the neck region is adapted to engage the slots 147 as shown in FIG. 5 where the head portion 292 applies a force in a longitudinal direction thereto. As shown in FIG. 14, it should be noted that the extension members 143 have a slight longitudinally head ward slant at the region indicated at 296 to help maintain the attachment portion 290 therewith the carriage 24 during operation. It should be further noted that in one form, the resistance system is such where the elastic members do not ride with the carriage. Of course, other embodiments could be employed where the elastic system moves with the carriage and is selectively attached to the frame to provide progressive resistance.

The foregoing description in mind, there will now finally be a discussion of the rebound motion control system 30. It should be noted that the rebound system 30 is further described as a range of motion control system. Referring now to FIG. 7 which is a sectional view taken at line 7-7 of FIG. 3, there is shown the rebound system 30 which in part is comprised in one form, the control cord 300 is a continuous piece of material as a unitary type structure. However, of course it could be made into various components.

As shown in FIG. 7, the control cord 300 is comprised of left and right lateral portions generally indicated at 322 and 324. In general, the control cord has an operating region 306 which is adapted to engage the various attachment points with regard to the frame 22 as well as the attachment points 150 and 152 with respect to the carriage 24. Therefore, the operating region 306 is comprised of a first cord section 310 and a second cord section 312. Although the first and second cord sections are extendable through the connection points 48 and 50, for purposes of operating the unit, they are partially fixed as will be further apparent as described herein. The operating region 306 further comprises an elastic member which is defined as 314 which is defined broadly as any type of member which resists separation of the first and second cord sections 310 and 312. In one form, the elastic member can be a elastic like loop with the cord sections 310 and 312 extending there through. Of course in other forms, it could be for example a spring like member attached in the region or the like.

Figure 9:
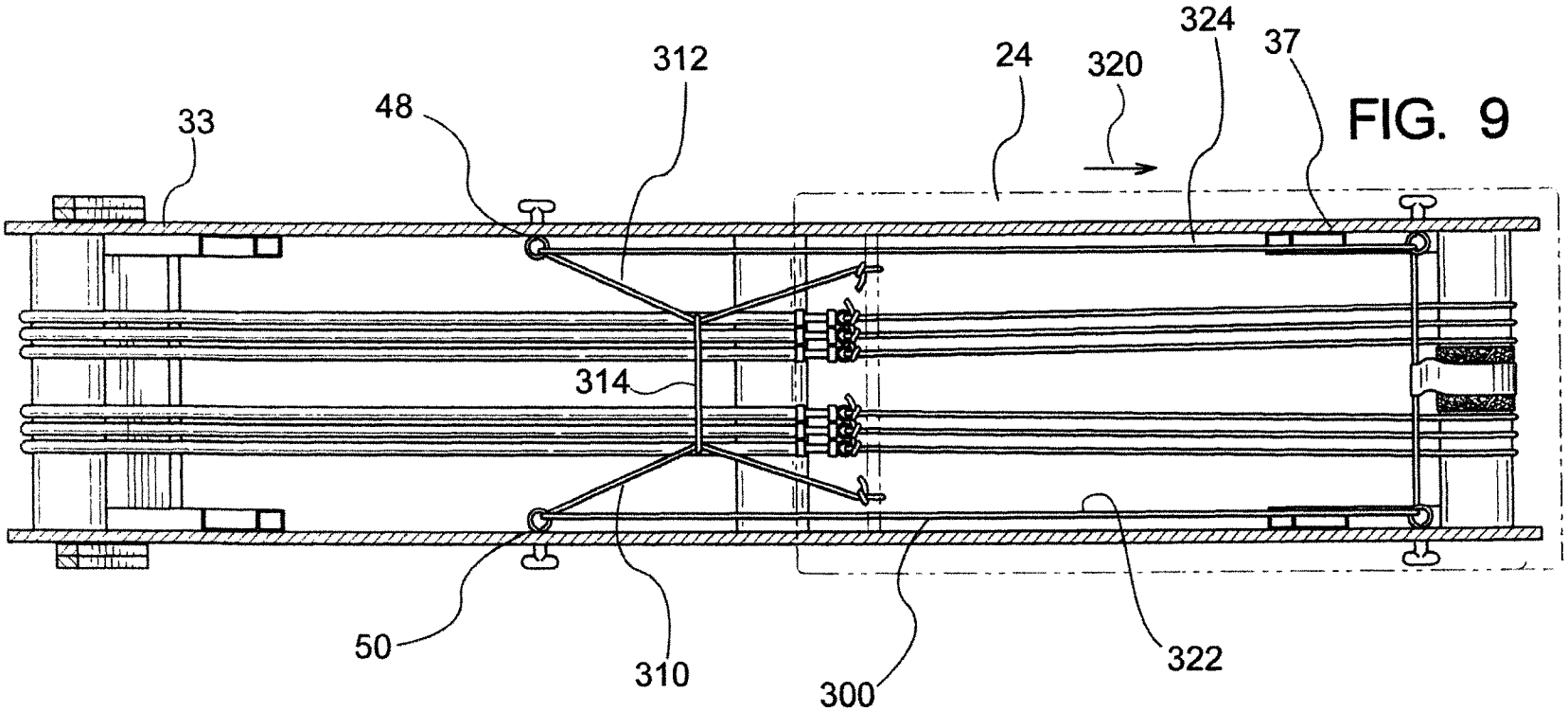
FIG. 9 shows the motion control system in a high-energy state or an intermediate flexible member is resisting separation of two lateral cord members as the carriage is repositioned in a longitudinally head ward direction.

It should be reiterated that the end portions of the first and second cord sections 310 and 312 are terminated at the anchor points 150 and 152 which are attached to the carriage 24. The other end portions of the cord sections 310 and 312 are attached at the connection points 48 and 50 of the frame 22. Therefore, now referring to FIG. 9, it can be appreciated that the carriage 24 is repositioned in a longitudinal headward direction as indicated by the arrow 320. To help aid in resisting the motion in this direction, it can be appreciated how the elastic member 314 is now in a higher stored energy state while the first and second cord sections 310 and 312 are repositioned laterally outwardly. Therefore, it can be appreciated given the basic kinetics of each of the cord sections at say for example referring to cord sections 310 is such that as the carriage 24 continues to be further positioned, the amount of tension in the members 310 and 312 increases exponentially longitudinally head wards. At this point, it should be noted that in one form, the rebound system 30 is configured in a manner where the first and second cord sections 310 and 312 extend around the contact points 48 and 50 which in one form are eye loop members and extend longitudinally rearwardly to the sections generally indicated at 322 and 324. As the carriage 24 extends in that longitudinal direction, tension is applied all throughout the various sections of the control cord 300 and the elastic properties of say for example the sections 322 and 324 are employed to further de-accelerate or otherwise provide a force upon the carriage 24 in the longitudinal foot ward direction (i.e. opposing the direction as indicated by the vector 320 in FIG. 9). In other forms, it should be noted that a secondary spring could be attached somewhere first or second along the cord extension portions 322 and 324.

Figure 11:
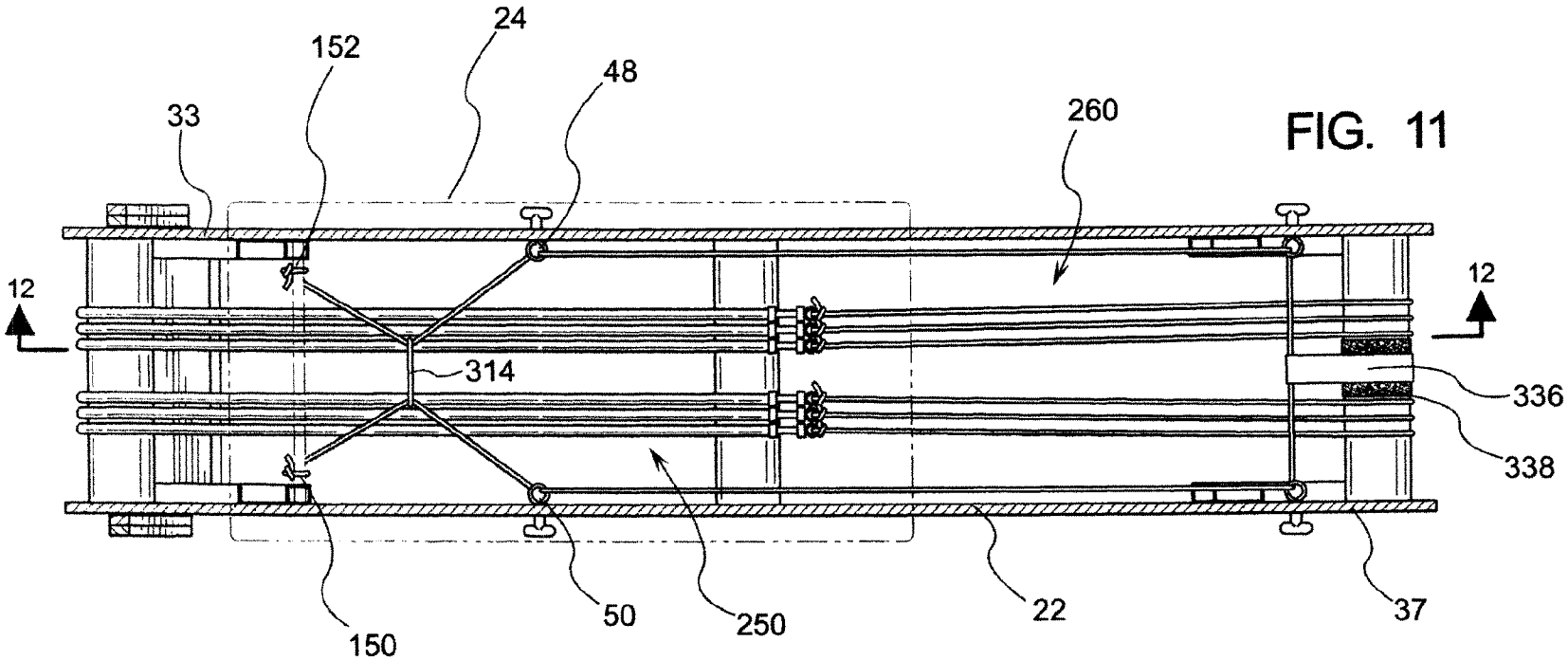
FIG. 11 shows a motion control system where the carriage is in a longitudinally foot ward orientation.

Therefore, it can be appreciated how the motion control/rebound control system 30 effectively limits the range of travel of the carriage with respect to the frame in one direction. Now referring to FIG. 11, it can be appreciated how the carriage 24 is now re-orientated in the foot ward portion 33 of the frame 22. In this form, the anchor points 150 and 152 are positioned in a longitudinally foot ward orientation with respect to the connection points 48 and 50. Therefore, in the orientation such that as shown in FIG. 11, the elastic member 314 is now beginning to expand in a lateral direction applying slight resistance opposing the motion of the carriage 24 in the longitudinally foot ward direction. Therefore, it can be appreciated that in one form the rebound system 30 will resist extreme motion of the carriage 24 with respect to the frame in either extreme longitudinal orientation.

Now referring back to FIG. 10, it can be appreciated that the rebound system 30 has an adjustment mechanism 330 which effectively shortens the length of the first and second cord sections 310 and 312. In one form, the sections of the control cord 300 namely, the cord extension portions 322 and 324 are connected at the central portion 334. As mentioned above, the control cord 300 in one form is one continuous strand of material. As shown FIG. 10, the attachment member 336 in one form is a hook and loop like attachment mechanism which is adapted to engage a corresponding hook and loop mechanism 338 which is best shown in FIG. 8. This can be accomplished via hook and loop members 336 and 334. As shown in this form, the member 336 can be adjustably positioned to effectively shorten the links of the sections 310 and 312 such that as shown in FIG. 10 or be relaxed to allow a greater range of motion of the carriage 24 with respect to the frame member 22.

Therefore referring back to FIG. 7, which is basically a top view of the unit with the carriage removed therefrom, it can be appreciated that much of the adjustment of the unit 20 can be accomplished at the head end. For example, the practitioner can grab any one of the attachment cords 260 for adjusting the resistance from the resistance system 26 as described in detail above. Further, the practitioner can adjust the amount of travel of the carriage 24 by manipulating the length in the longitudinal direction of the member 336.

With respect to cord sections it should be noted that the first and second cord sections 310 each have first attachment regions 311 and second attachment regions 313 where at the second attachment regions the cord sections are effectively attached there to the frame which means either rigidly attached thereto or attached in a manner as shown in FIG. 7 by way of the loop like portions indicated at 48 and 50 where the cord extends longitudinally rearwardly along the cord extension portions 322 and 324.

Figure 16:
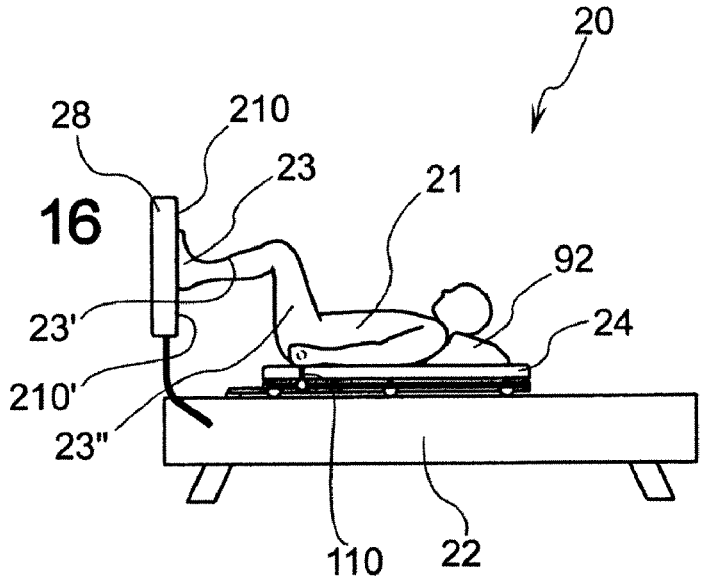
FIGS. 16-28 in general show various types of exercises/therapeutic movements of an exercise participant utilizing the apparatus 20.
Figure 17:
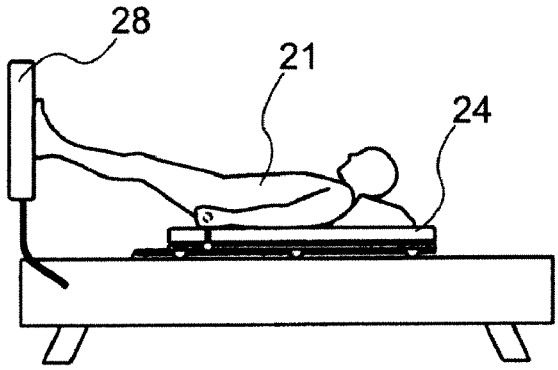
Figure 18:
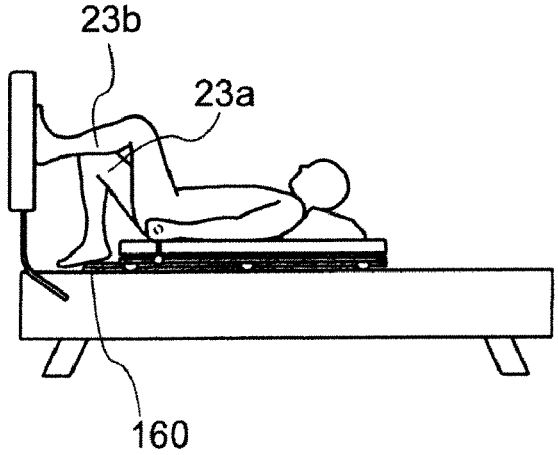
Figure 19:
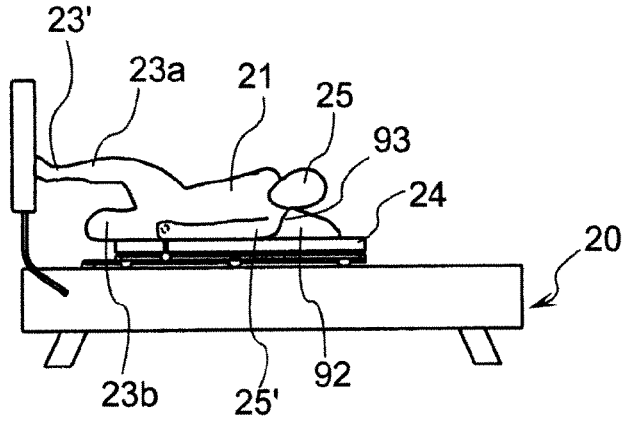

Now referring to FIGS. 16-28, there is shown a variety of exercises/therapeutic movements that can be executed with the apparatus 20. For example, as shown in FIGS. 16, 17 and 18, the exercise participant 21 is positioned in the supine position upon the carriage 24. The kick plate 28 is in the operable orientation where the surface 210 is orientated in a manner to make contact with the foot region 23 of the participant 21. Prior to engaging in the exercise, the selected degree of resistance is applied to the carriage by way of the resistance system described above. Further, the range of motion of the carriage 24 with respect to the support structure 22 is adjusted by way of adjusting the rebound system 30 as described above with reference to FIGS. 9 and 10 by adjusting the strap 336. Further, the headrest 92 is adjusted on the carriage to allow for a proper orientation of the central torso region of the exercise participant 21 on the carriage. In one form, the kick plate 28 is a fixed structure relative to the frame when in the operable orientation. Therefore, to adjust the degree of bend within the leg portions 23' and 23", the torso of the individual 21 is adjusted by way of repositioning the headrest. Further, the handle members are adjusted where the handle number 110 as shown in the left-hand portion of the unit is adapted to reposition along the attached guide rail for proper ergonomic orientation with the individual 21. Of course, the hand members are in some forms optional where the resistance is very slight, or otherwise there is a sufficient amount of counteracting force between the participant 21 and the carriage 24 so the participant does not slide off the carriage.

Still referring to FIG. 16, it can be seen that the exercise participant is ready to engage in a therapeutic/exercise movement. Therefore, the lower limb 23' is positioned at a desirable orientation upon the surface 210. It should be noted that the surface 210 has a sufficient dimension which in FIG. 16 is orientated in the substantially vertical direction to allow for a plurality of leg positions. For example, if the individual desires to have more of a direct pressure along the lower limb 23' where the knee joint presses a resultant force directly downward to prevent any shearing-type action in the knee in the event there is, for example, a meniscus injury, it would be desirable to provide enough of the material of the kick plate 28 in a vertical orientation so the individual's foot 23 is placed sufficiently high enough to allow for such direct downward pressure along the lower limb 23'. However, if the individual wishes, for example, to work more of the quadriceps and has healthy patella tendons, the exercise participant may position his or her foot 23 in the lower region indicated at 210" of the surface 210 and may be up on the balls of his or her feet to work the quadriceps and perhaps allow for a greater range of motion with respect to the lower and upper leg regions 23' and 23".

Now referring to FIG. 17, it can be appreciated how the carriage 24 is repositioned in the head ward longitudinal region and the leg portions of the exercise participant 21 have now a more extended orientation. In some forms, the exercise participant may accelerate sufficiently to separate from the kick plate 28.

It should further be noted of course that the kick plate 28 could be readily repositioned from the hatched line 28' as shown in FIG. 1 to he stowed position, and the unit 20 can then serve as a therapy table or as a horizontal surface for any purpose.

Figure 15A:
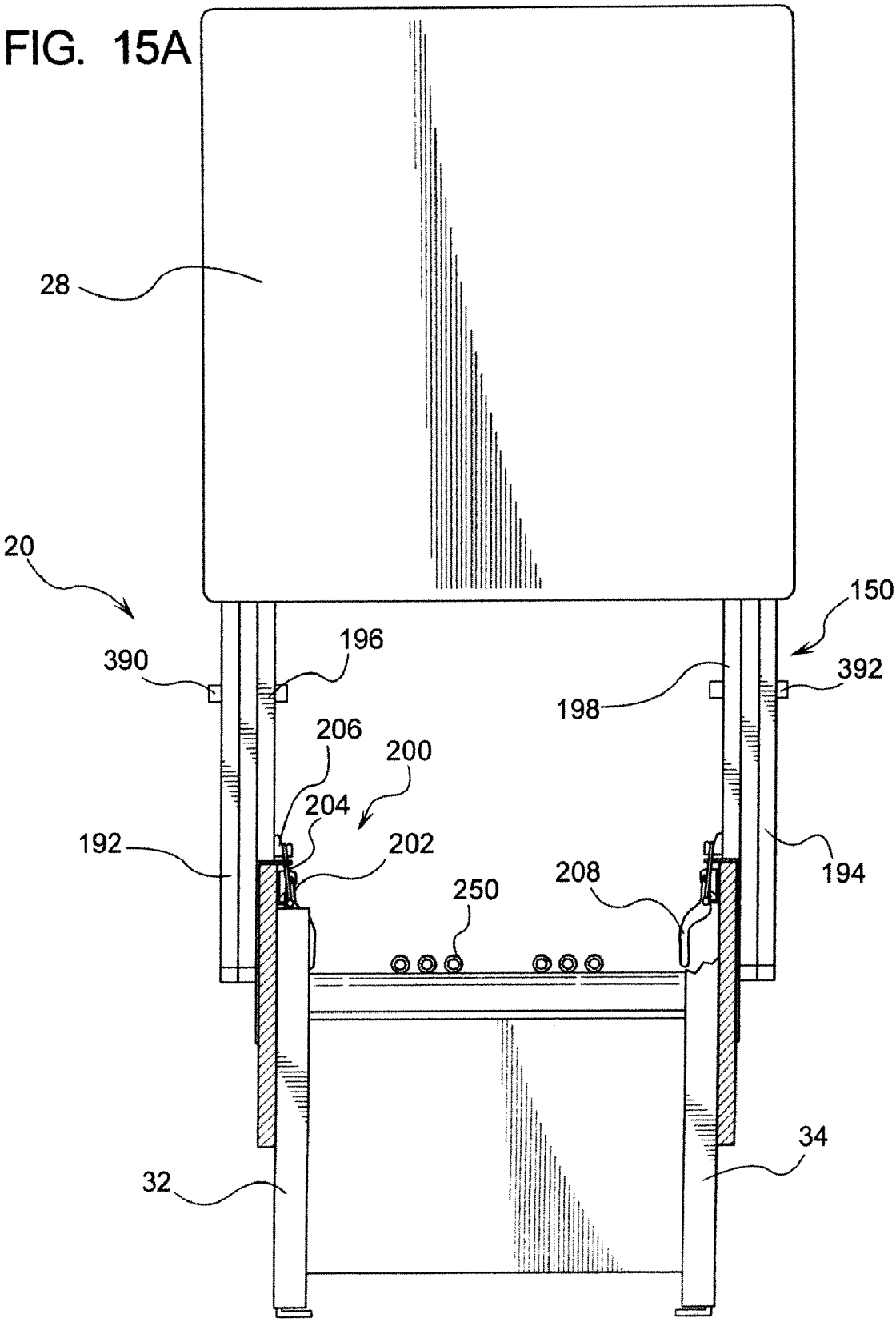

It should be noted, as shown in FIG. 15A, that the various vertically extending members comprising the left and right supports 192 and 196 could be shackled together to prevent flexion amongst the members by the attachment mechanisms 390 and 392.

Figure 15B:
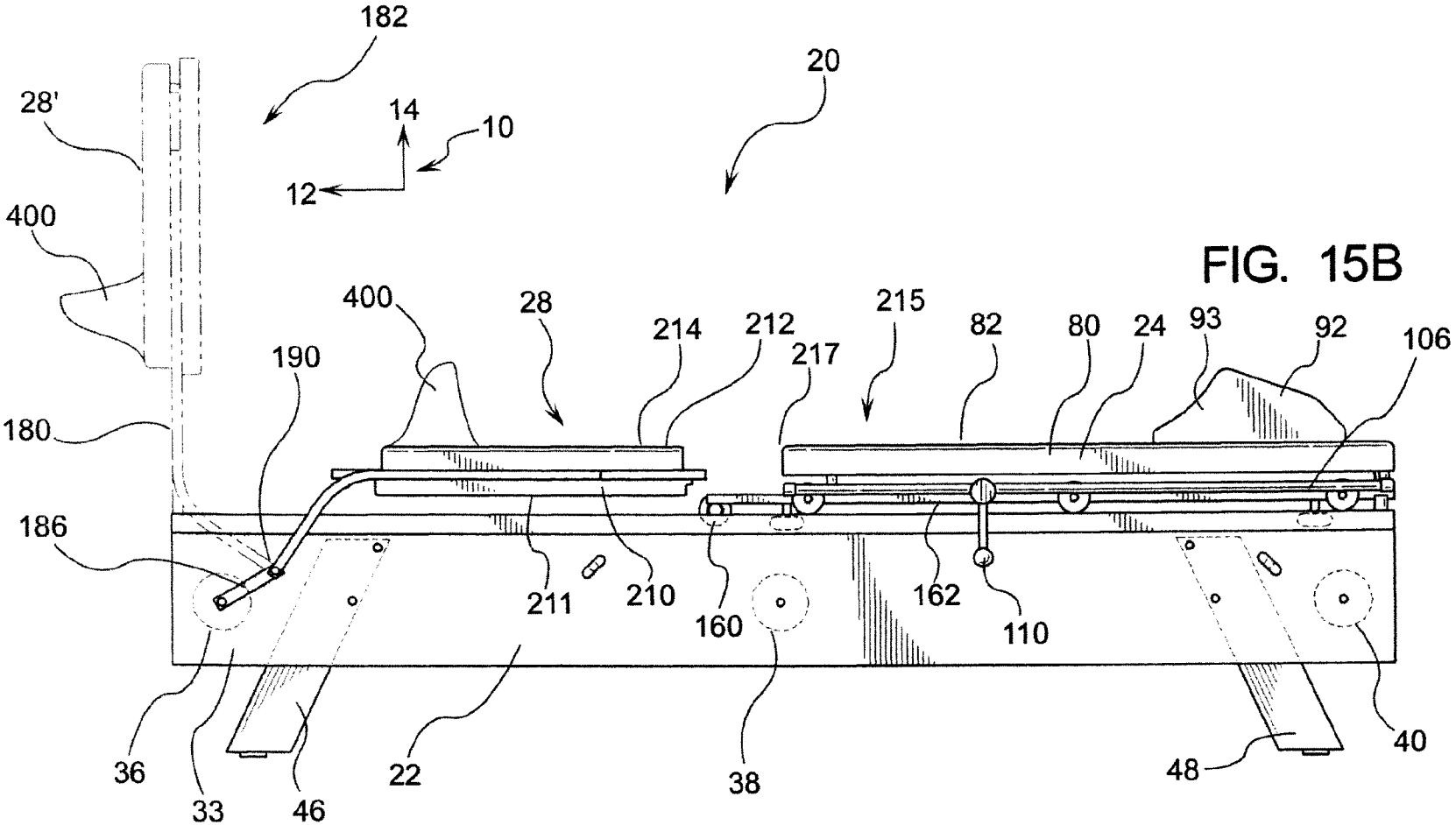

Now referring back to FIG. 15B, it should be further noted that at the surface indicated at 214, a platform 400 can be placed thereon when the unit is in a stowed orientation, and this platform-like device would have a vertically extending portion that is adapted to have force imparted by the exercise participant. Therefore, in the stowed position, the unit can be utilized as an exercise therapeutic device in a similar manner and concept as in the operative orientation, but utilizing a modified-type kick plate. Therefore, the platform 400 can be a hook-and-loop removal platform in a similar manner as the headrest, or can be a permanently or more rigidly attached-type fixture. In one form, the footplate can reposition in the longitudinal forward direction as shown in FIG. 15B to provide some range of motion for the exercise participant. Further, this adjustment can be utilized when in the operational orientation to adjust the height of the kick plate with respect to the frame member.

Figure 15C:
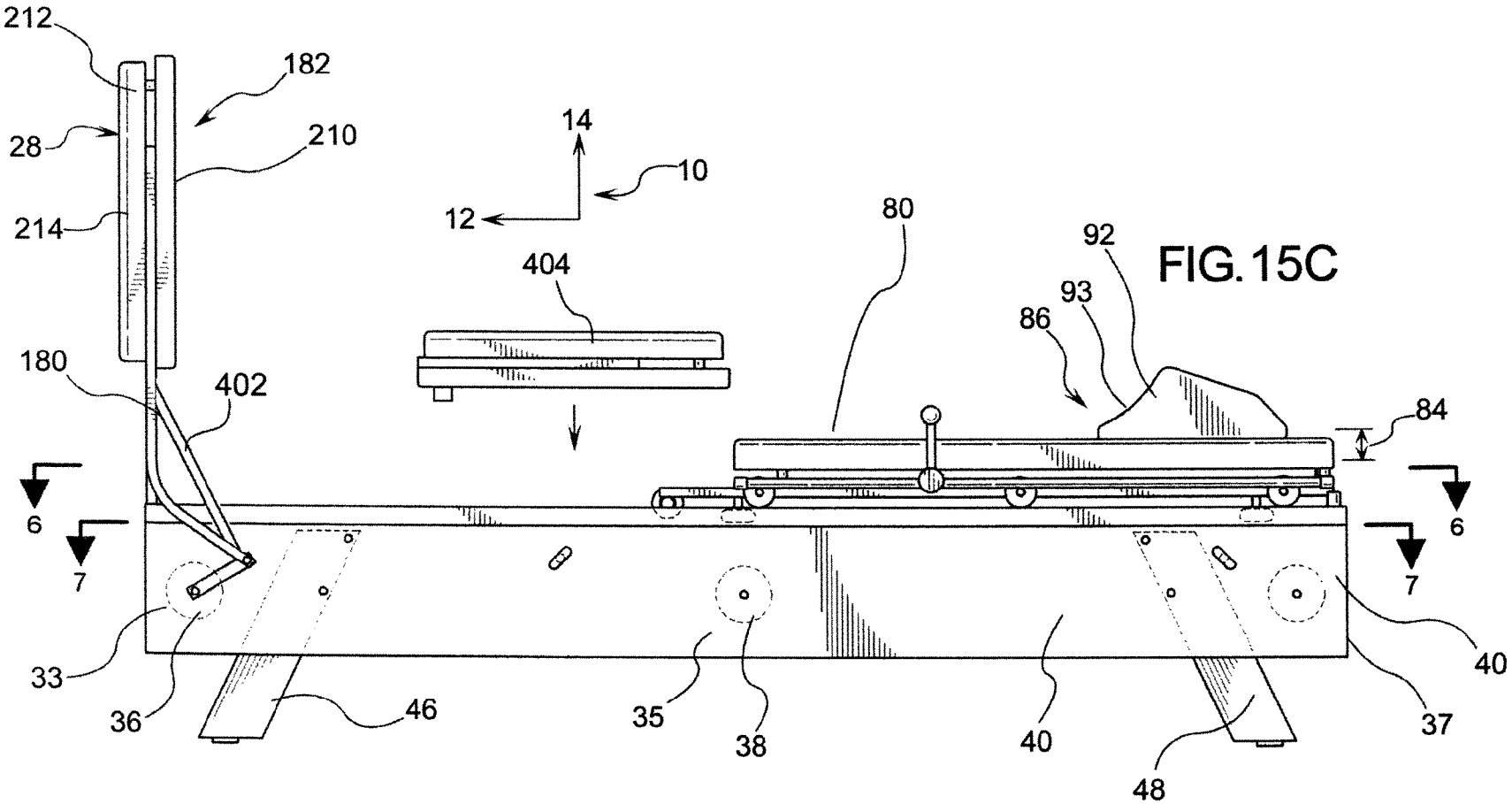

Referring now to FIG. 15C, there is shown another embodiment where the kickplate 28*a* can be a fixed-type kick plate where the members 402 are positioned to triangulate the forces to provide greater rigidity for the kickplate. The insert 404 is provided to create a table-like member for the unit when in a stowed orientation. In one form, the member 404 can be attached, for example, to the rearward portion of the hook plate.

It should further be noted that when the second surface of the kickplate and the upper surface of the carriage are in the stowed position, the surfaces are adjacent to one another, which is broadly defined as the surfaces being in sufficiently close proximity to operate as a table. Of course, the term adjacent and in-plane could be interpreted in a number of broad ways, for example the padding in one of the materials could be greater where the resting surfaces of either the carriage of the kickplate may extend vertically beyond the other. However, when compressed down, the surfaces are can be positioned in closer proximity to one another.

Figure 20:
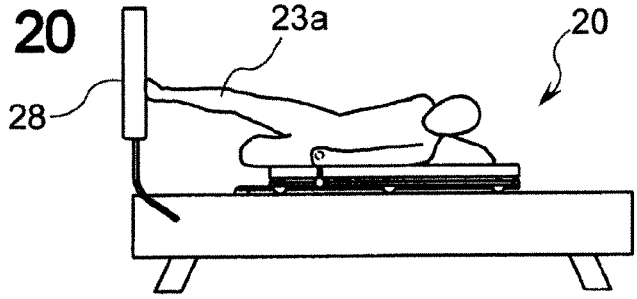

Now referring to FIG. 18, there is a variation of the exercise where the leg portions 23*a* is resting upon the footrest 160 and the opposing leg member 23*b* is being worked. Now referring to FIG. 19, it can be appreciated how the exercise participant 21 is positioned in a slightly oblique manner where he or she has rotated about a longitudinal axis where their left shoulder is in engagement with the upper surface of the carriage 24. In this form, the individual's head 25 is positioned upon the headrest 92, and their shoulder region 25' can engage the forward surface 93 of the headrest. In this form, the upper surface of the carriage has a sufficient lateral width to allow for the lower leg member 23*b* to be positioned upon the lower surface region and the forward longitudinal direction of the carriage 24. In this fashion, the upper leg member 23*a* can provide a slightly different orientation where the individual can position the lower leg portion 23*b* in a variety of orientations for different kinematic effects upon the body. FIG. 20 shows the leg 23*a* in an extended positioned.

Figure 21:
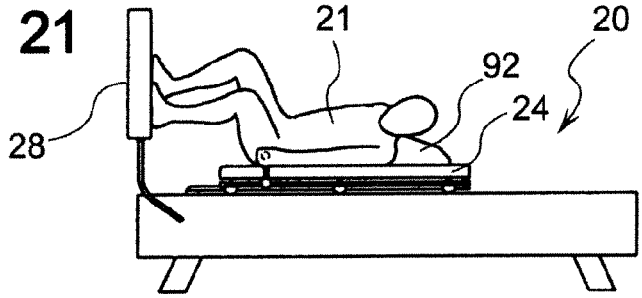
Figure 22:
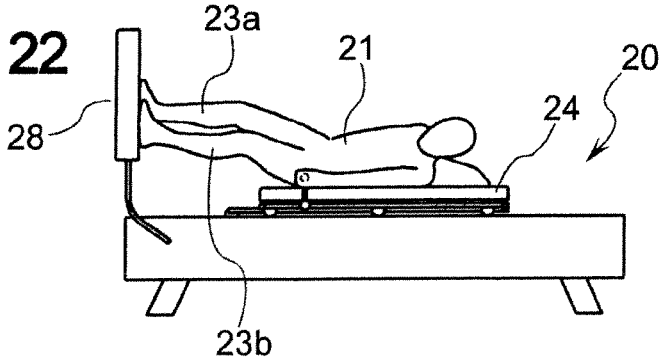

Now referring to FIGS. 21 and 22, it can be seen that the exercise participant 21 is still orientated in the oblique orientation where their left shoulder is positioned upon the upper surface of the carriage 24. It should be noted that the pliable head support 92 can operate as a shoulder support and be quite versatile in positioning an individual for a variety of body orientations with respect to the apparatus 20.

As shown in FIGS. 23 and 24, there is shown another type of exercise where the individual places his or her lower leg 23*b* on the footrest 160, and the opposing leg 23*a* presses off the kick plate 28. In this form, the participant 21 can work on their hamstring therapy.

Figure 25:
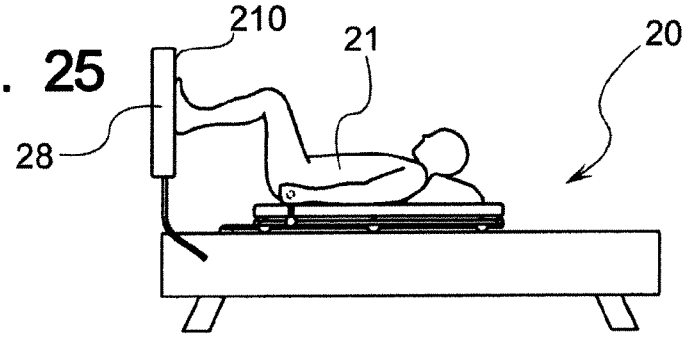
Figure 26:
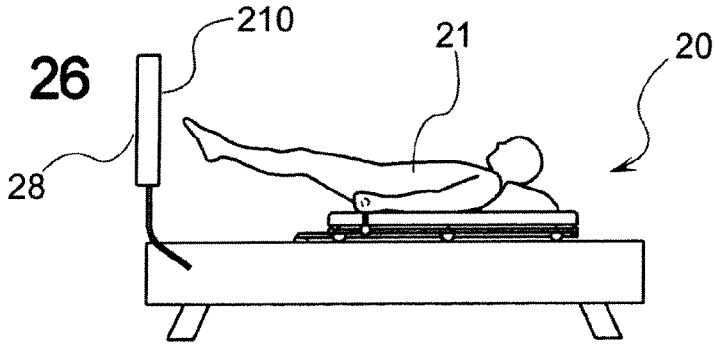

Referring to FIG. 25, there is shown more of a dynamic type of exercise where the participant 21 generates a sufficient amount of thrust of the kick plate 28 to project them from the surface 210 such as that shown in FIG. 26.

Figure 27:
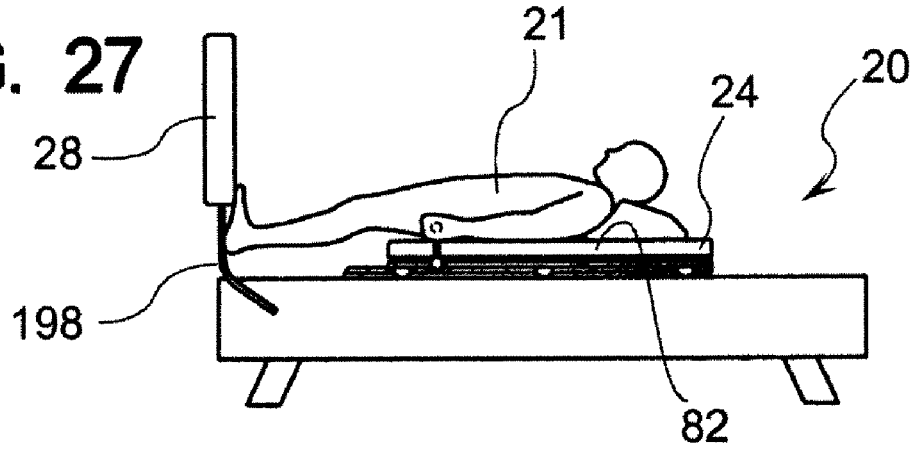
Figure 28:
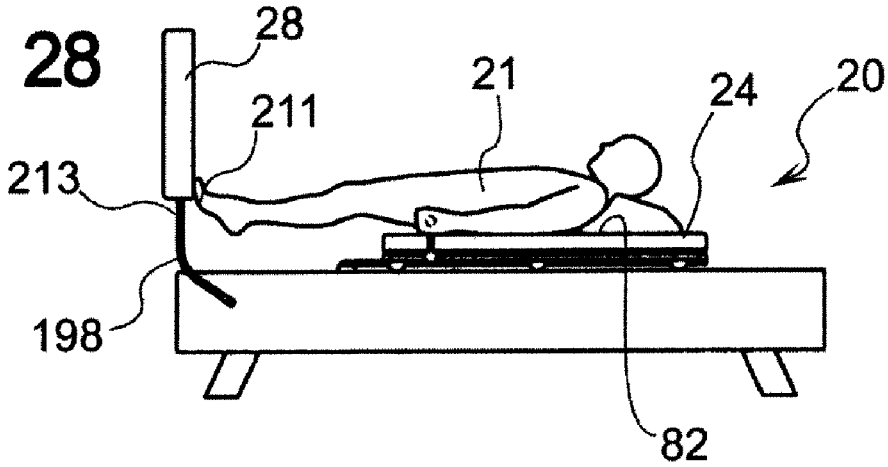

Now referring to FIG. 27, there is shown yet another embodiment where the lower portion 211 of the kick plate 28 provides a central open area to 213 between the left and right supports where the support 198 is shown in FIGS. 27 and 28. Therefore, the user can engage in a toe raise-type therapeutic/exercise movement to work the gastrocnemius of the lower leg. It should be noted that the lower ridge 211 is positioned sufficiently above the upper surface of the carriage 24 to allow for a proper ergonomic orientation of the upper torso of the participant 21 with respect to their leg orientation. For example, the lower edge 211 can be placed at for example eleven inches or six to thirteen inches in one range, or three to seventeen inches in the broader range, above the plane defined by the upper surface 82 of the carriage 24.

Looking to FIGS. 29 through 32, an improved leg design is shown, which allows for height and angle adjustability of the frame 22 relative to the floor 406. In general, it may be desired to have the carriage 24 at a height 408 of 19 inches, such that the upper surface 82 of the carriage 24 may function as a couch or similar comfortable seating structure. As space is often a serious concern in therapeutic environments, it may often be desired to have a place where patients or practitioners may be seated comfortably. In the embodiment shown, the overall height 408 may be adjusted to other heights, such as 24 inches, wherein the combination device 420 may function as an exercise table, wherein the user would lie upon the upper surface 82 of the carriage 24, as previously described. Additionally, it has been found that a height 408 of 29 inches provides an excellent height for manipulative therapy, such as massage. Thus, by utilizing the adjustable device 420, a practitioner may have multiple uses within a single space for the combination exercise device.

Figure 30:
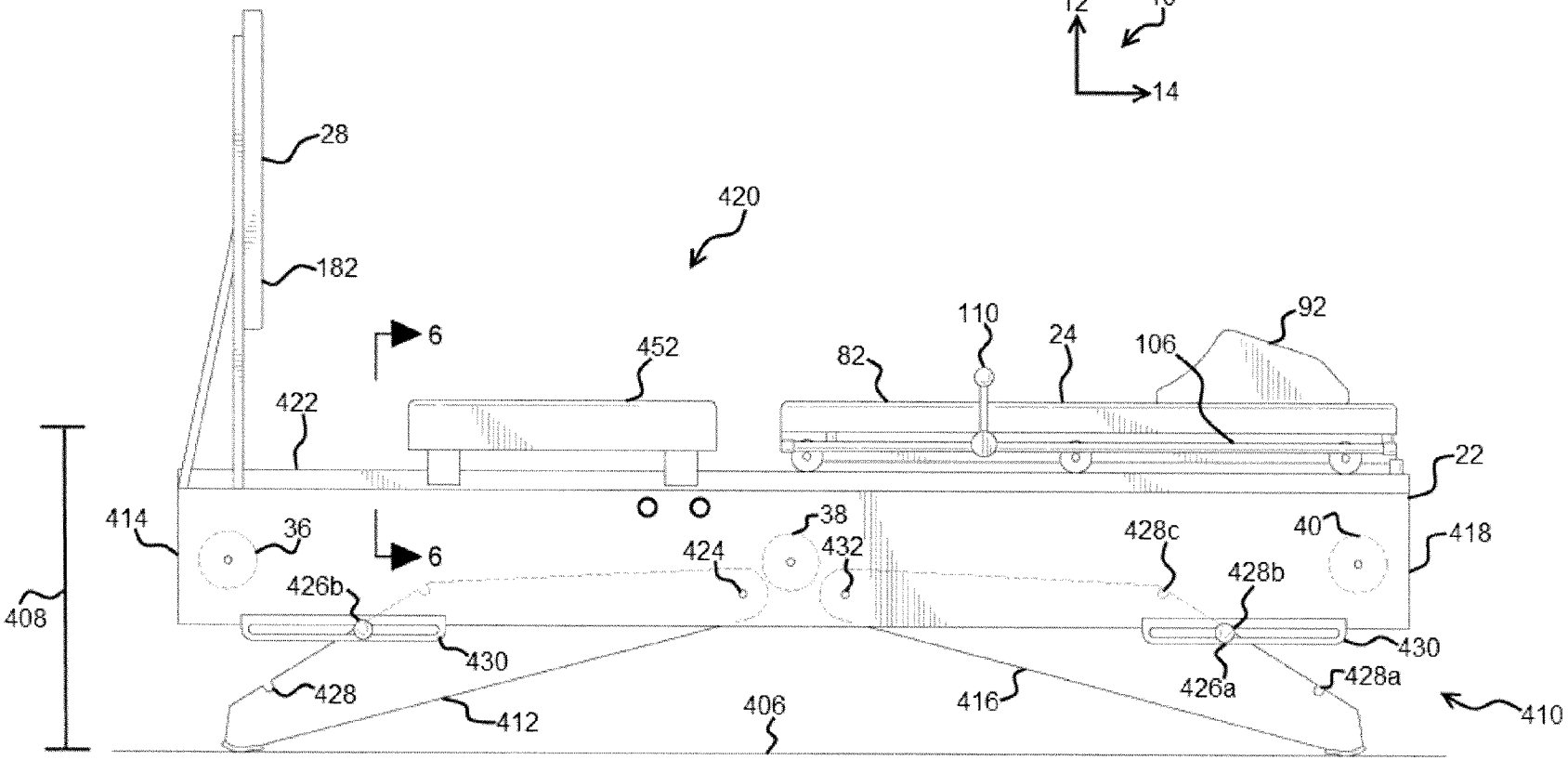
FIG. 30 is a side view of an improved combination exercise treatment table with height adjustable legs in their middle position in one form.

As shown, mainly with respect to FIG. 30, the height adjustable system 410 comprises a first leg assembly 412 near the foot end 414 of the frame and a second leg assembly 416 near the head end 418 of the frame 22. While the first leg 412 and second leg assembly 416 may be operated together, they may also be operated independently to adjust the relative angle of the upper edge of the frame 422 relative to the floor 406 for angular use of the carriage 24. Of course, while the upper edge of the frame 422 is discussed, it is the relative orientation of the surface upon which the carriage 24 rolls relative to the floor 406 that is important in this use. To enable height adjustability, several different leg embodiments may be utilized. One simple and effective embodiment is formed by providing a first pivot 424, around which the first leg assembly 412 pivots. A locking bar 426 longitudinally is adjusted to rest upon a plurality of grooves 428 to enable height adjustability. In one form, the locking bar 426 slides longitudinally within a retaining plate 430. Similarly, a second pivot 432 may be provided, which allows the second leg assembly 416 to pivot thereabout. In one form, the pivots 424 and 432 may comprise a bolt or similar device which can be utilized to retrofit existing treatment tables with height positionable legs. Thus, another locking bar 426 may be held captive within a retaining plate 430 near the head end 418 of the frame 22 to allow for the second leg assembly 416 to be positioned at varying angles relative to the frame 22, thus adjusting the height of the head end 418 of the frame 22 relative to the floor 406.

Figure 29:
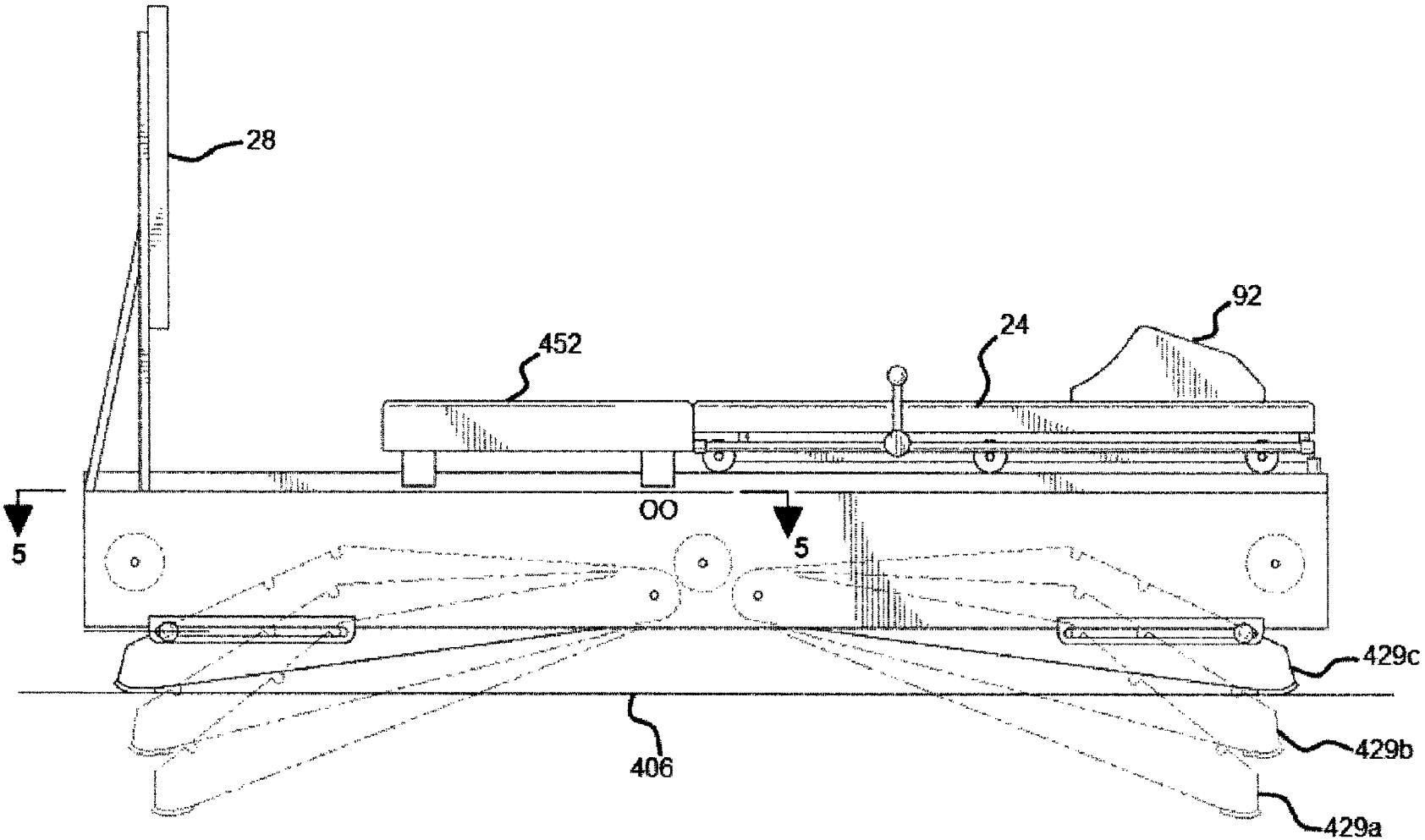
FIG. 29 is a side view of an improved combination exercise treatment table with height adjustable legs in their lowest position in one form.

While one of ordinary skill in the art can appreciate that multiple grooves 428 may be utilized, in the embodiments shown in FIGS. 29 through 30, a lowest position groove 428*a*, a middle position groove 428*b* and a highest position groove 428*c* are provided. In FIG. 29, both the forward locking bar 426*a* and the rear locking bar 426*b* are set within a middle position groove 428*b*. In one example, this would result in the upper surface 82 of the carriage 24 being set approximately at 24 inches relative to the floor 406 in a substantially horizontal orientation. Now looking FIG. 31, each of the locking bars 426*a* and 426*b* are set within the highest position groove 428*c*. As previously described, this adjustment may set the upper surface 82 of the carriage 24 at a height 408 of approximately 29 inches to be used as a treatment table for massage etc. A practitioner would position the locking bars 426*a* and 426*b* within the lowest position groove 428*a*, which in one form would fix the upper surface 82 of the carriage 24 in a substantially horizontal arrangement approximately 19 inches above the floor, for use as a couch or similar furniture piece or treatment device.

Figure 32:
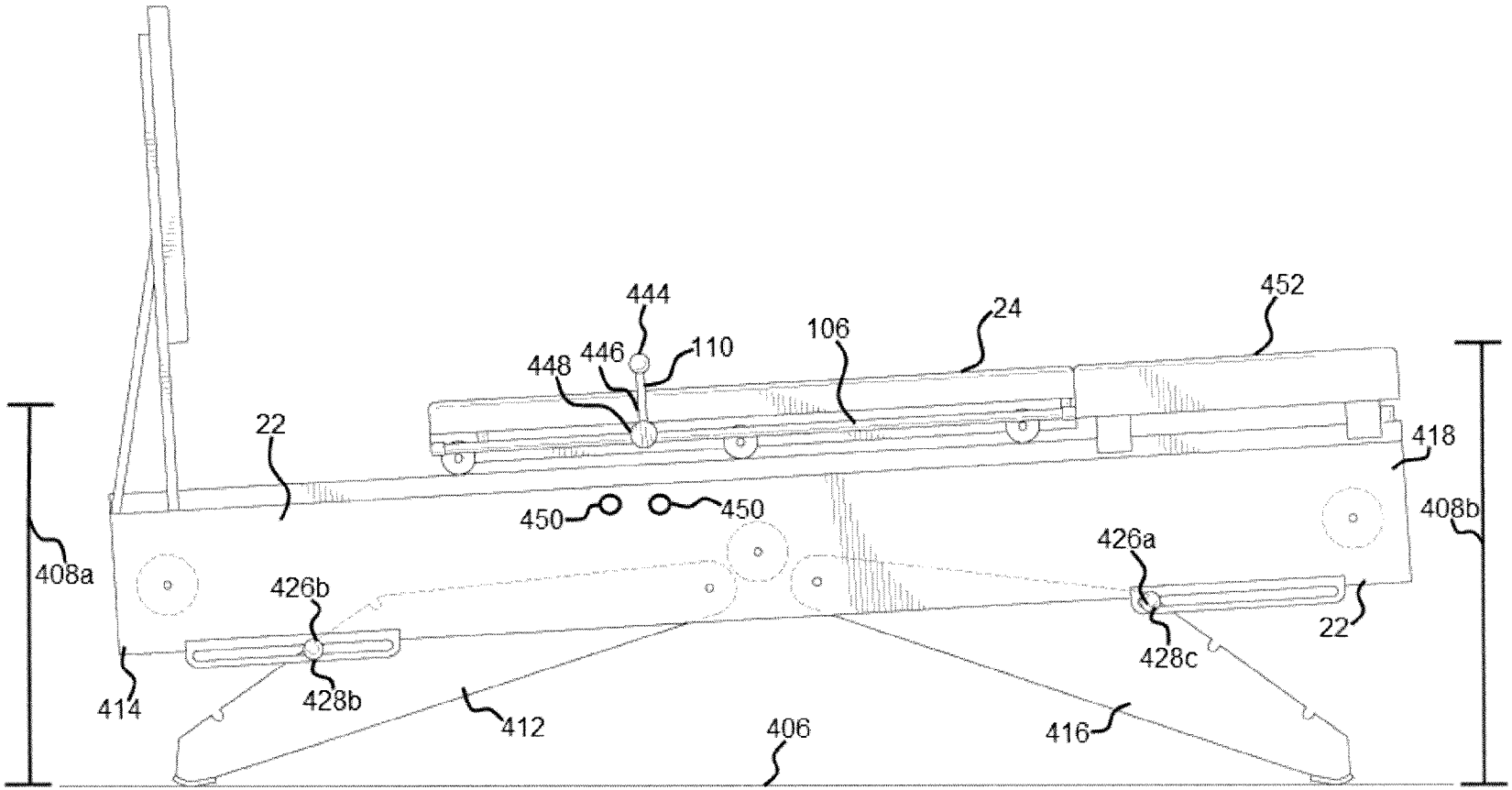
FIG. 32 is a side view of an improved combination exercise treatment table with height adjustable legs in their middle position in one form.

Looking to FIG. 32, the treatment table is arranged at a relative angle to the floor 406, wherein the first leg assembly 412 has been set such that the locking bar 426*b* is set within the middle position groove 428*b*, and the second leg assembly 416 comprises a locking bar 426*a* set within the highest position groove 428*c*. Thus, the height 408*a* of the foot end 414 is substantially lower than the height 408*b* of the head end 418 of the frame 22. In this arrangement, the user may be at a much more comfortable position, and additionally, the inclination may provide for additional resiliency for treatment.

Figure 33:
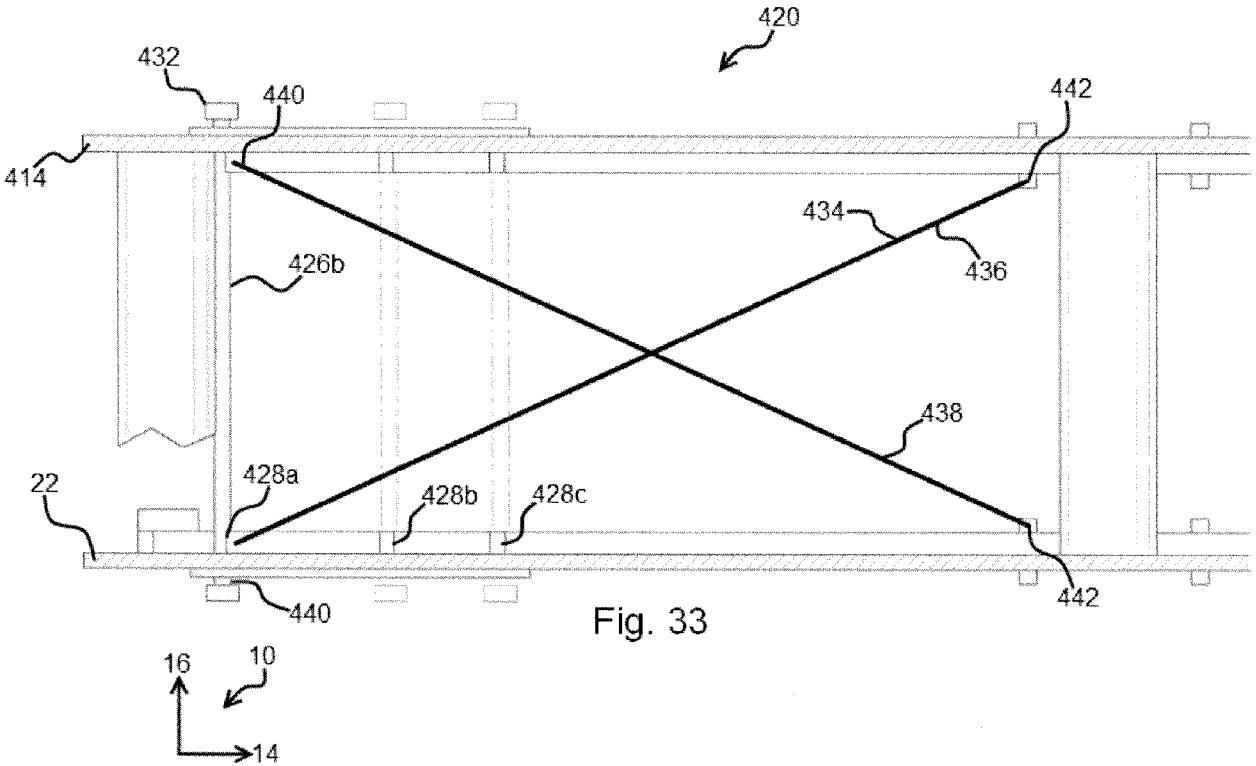
FIG. 33 is a top view of an improved combination exercise treatment table with height cross bracing in one form.
Figure 34:
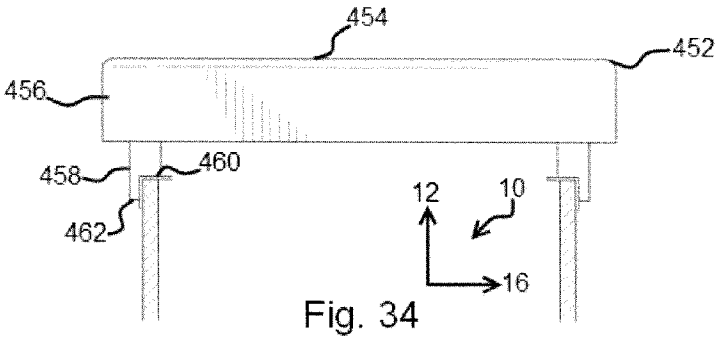
FIG. 34 is an end view of an improved combination exercise treatment table with a removable surface assembly in one form.

FIG. 33 shows the device 420 in a plan view adjacent the foot end 414 of the frame 22. As shown, the locking bar 426*b* is shown in the lowest position, adjacent the lowest position groove 428*a*. The locking bar is also shown in ghost lines, adjacent the middle position groove 428*b* and the upper position groove 428*c*. Also as shown, each of the locking bars 426 may be fitted with an end portion 432, which maintains the locking bar 426 within the retaining plate 430.

Also shown in FIG. 33 is an optional cross bracing 434, comprising a first cross member 436 and a second cross member 438. Each of these cross members is attached to the frame 22 at a rearward end 440 and a forward end 442. The cross bracing 434 may be incorporated for use with large patients, or patients who are likely to vigorously utilize the apparatus 420, wherein such cross bracing with the useful.

While the handle members 110 have been previously described, a more detailed description of their use will be incorporated herein. Looking to FIG. 32, the handle member 110 is shown attached to the guide bar 106. In one form, the end knob 444 is rigidly coupled to the extension 446 and threadedly engaged within an end slider 448, which is operably configured to slide longitudinally along the guide bar 106 when released. When the end knob 444 and extension 446 are rotated, tension is released relative to the guide bar 106, such that the handle member 110 is permitted to slide longitudinally along the guide bar 106 and also is permitted to rotate thereabout. As it is often desired to lock the carriage 24 in relative position to the frame 22, a plurality of extensions may extend laterally from the frame 22. When it is desired to lock the carriage 24 relative to the frame 22, the handle member 110 is released, longitudinally positioned, and simultaneously rotated to fit between the extensions 450 and positioned therebetween while tension is provided between the handle member 110 and guide bar 106, such that the handle member 110 is temporarily fixed relative to the guide bar 106. This can be accomplished either by substantially tensioning the handle member 110 and then rotating it about the guide bar 106 to fit between the extensions 450, or alternately to position the handle member 110 prior to tensioning. While it is not shown, the handle members 110 may be provided on either or both lateral sides of the carriage 24. In practice, a practitioner may desire to have multiple extensions 450 provided along the carriage 24 for even more adjustability; however, it has been found that a single pair positioned near the longitudinal centerline of the frame 22 is normally sufficient.

Figure 31:
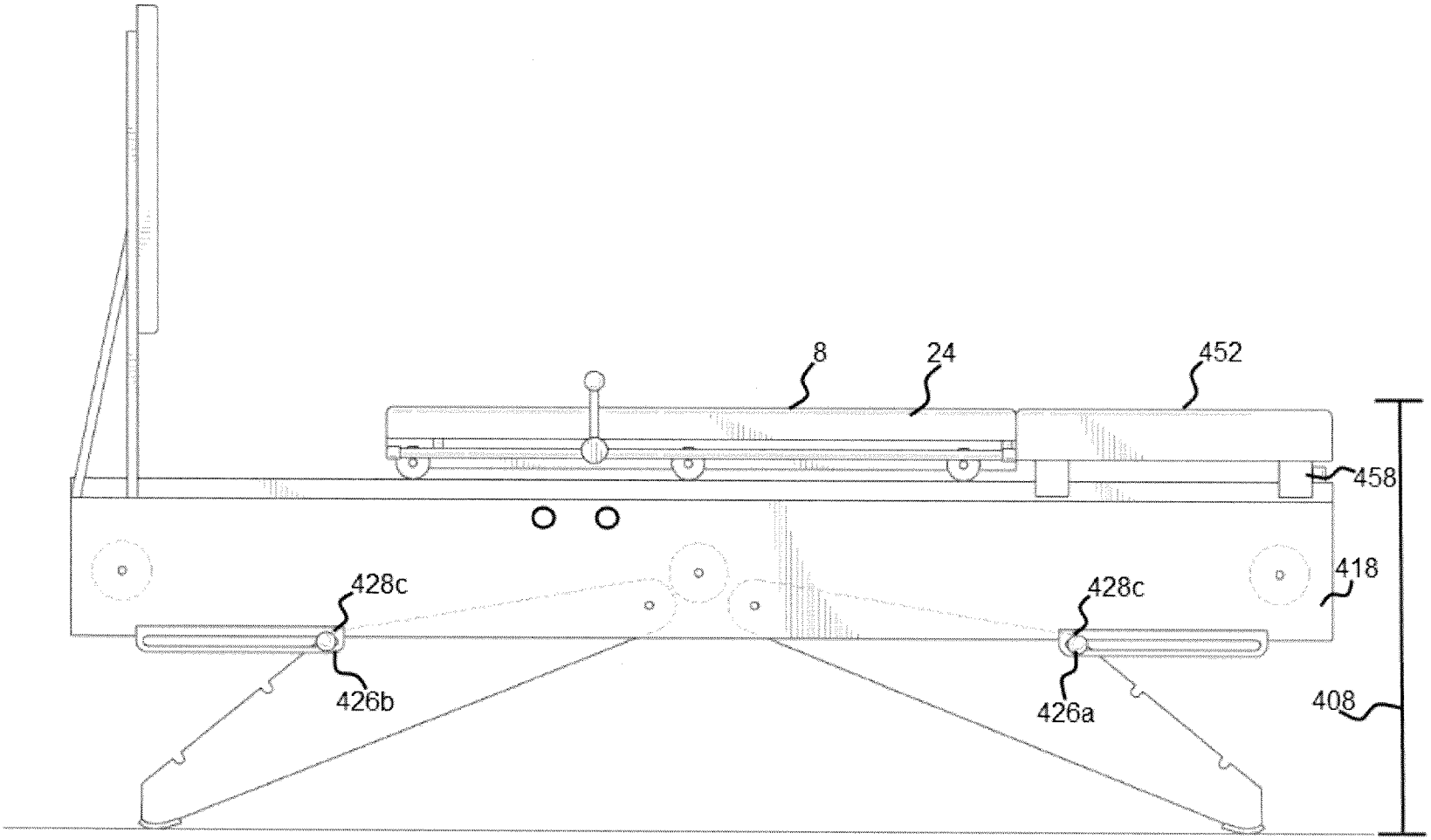
FIG. 31 is a side view of an improved combination exercise treatment table with height adjustable legs in their highest position in one form.

Looking to FIGS. 29-32, and 34, a removable surface assembly 452 is shown. Looking specifically to FIG. 34, the removable surface assembly 452 comprises an upper surface 454, a body panel 456, and a plurality of guides 458, comprising a downward facing surface 460 and alignment fingers 462. The guides 458 allow for the surface assembly 452 to rest upon the upper edge of the frame 422 at either the foot end 414, as shown in FIG. 30, or adjacent the head end 418, as shown in FIG. 31. When in place upon the upper edge 422 of the frame 22, the removable surface assembly 452 functions to enlarge the surface of the device 420 for use as a couch or as a stationary treatment table. Of course, a plurality of removable surface assemblies 452 could be incorporated, such as one at the head end 418 and a second one at the foot end 414. The benefits of such an arrangement have been previously described, and as previously described it may be desired to remove the headrest 92, which is shown in FIG. 29. FIGS. 31 and 32 obviously show the headrest 92 removed.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A height adjustable combination exercise, therapy table for an individual comprising:

a) a frame comprising a plurality of rails adjacent the upper edge of the frame, the frame having a head end and a foot end, b) a user supporting carriage movably coupled to the frame and operatively configured to allow longitudinal movement of the carriage upon the rails, relative to the frame;

c) a plurality of elastic members coupled between the frame and the carriage and operatively configured to bias the carriage toward the foot end of the frame, d) the carriage having a substantially planar upper surface;

e) a kickboard mounted to the frame;

f) the kickboard having a substantially vertical surface;

g) a first leg fixedly and pivotably coupled to a first longitudinal end of the frame, the first leg extending below the frame and as a result of pivoting relative to the frame, operatively configured to adjust the elevation of the first longitudinal end of the frame relative to the floor;

h) a second leg fixedly and pivotably coupled to a second longitudinal end of the frame, the first leg extending below the frame and as a result of pivoting relative to the frame, operatively configured to adjust the elevation of the second longitudinal end of the frame relative to the floor;

i) wherein the first and second leg are configured to be arranged in such a way that in at least one combination, the substantially planar upper surface of the carriage is substantially horizontal to the floor; and, j) wherein the first longitudinal end of the frame is longitudinally opposed to the second longitudinal end of the frame.

2. The adjustable combination exercise, therapy table as recited in claim 1 wherein;

a) the first leg is operatively configured such that the upper surface of the carriage above the first leg is positionable between 19 inches and 29 inches above the floor.

3. The adjustable combination exercise, therapy table as recited in claim 2 wherein;

a) the first leg comprises a first side leg and a transverse opposing side leg which are interconnected to pivot as a single structure.

4. The adjustable combination exercise, therapy table as recited in claim 2 further comprising;

the second leg is a) operatively configured to allow the second longitudinal end of the frame to adjust such that the upper surface of the carriage above the second leg is positionable between 19 inches and 29 inches above the floor.

5. The adjustable combination exercise, therapy table as recited in claim 4 wherein the first leg and the second leg interoperate to position the combination exercise, therapy table such that the upper surface of the carriage can be positioned in a substantially horizontal orientation.

6. The adjustable combination exercise, therapy table as recited in claim 2 further comprising:

a) at least one removable bed, operatively configured to removably attach to the frame; and b) the removable bed comprises an upper surface which is substantially planar, and when in place on the frame, is substantially coplanar with the upper surface of the carriage.

7. A retrofit kit for a combination exercise treatment table comprising a frame comprising a plurality of rails adjacent the upper edge of the frame, the frame having a head end and a foot end, a user supporting carriage movably coupled to the frame and operatively configured to allow longitudinal movement of the carriage upon the rails, relative to the frame; and a plurality of elastic members coupled between the frame and the carriage and operatively configured to bias the carriage toward the foot end of the frame, the retrofit kit comprising:

a) a plurality of legs operably configured to be pivotably coupled to the frame and support the treatment table above the floor at an adjustable height therefrom, and b) a locking mechanism operably configured to maintain the legs in relative position to the frame.

8. The retrofit kit as recited in claim 7 wherein the locking mechanism comprises a bar extending substantially from one lateral side of the frame to the opposite lateral side of the frame.

9. The retrofit kit as recited in claim 8 wherein the locking mechanism comprises at least one retaining plate operatively configured to maintain the bar in a relative vertical position relative to the frame.

* * * * *